US008802192B2

(12) United States Patent
Kawakita et al.

(10) Patent No.: US 8,802,192 B2
(45) Date of Patent: Aug. 12, 2014

(54) WARM SPRAY COATING METHOD AND PARTICLES USED THEREFOR

(75) Inventors: Jin Kawakita, Ibaraki (JP); Seiji Kuroda, Ibaraki (JP)

(73) Assignee: National Institute for Materials Science, Ibaraki (JP)

( * ) Notice: Subject to any disclaimer, the term of this patent is extended or adjusted under 35 U.S.C. 154(b) by 410 days.

(21) Appl. No.: 12/448,067

(22) PCT Filed: Sep. 14, 2007

(86) PCT No.: PCT/JP2007/067998

§ 371 (c)(1),
(2), (4) Date: Dec. 28, 2009

(87) PCT Pub. No.: WO2008/068942

PCT Pub. Date: Jun. 12, 2008

(65) Prior Publication Data

US 2010/0136229 A1 Jun. 3, 2010

(30) Foreign Application Priority Data

Dec. 7, 2006 (JP) ..... 2006-330067
Mar. 13, 2007 (JP) ..... 2007-062821

(51) Int. Cl.
*B05D 1/12* (2006.01)
*B32B 5/16* (2006.01)
*C23C 24/04* (2006.01)

(52) U.S. Cl.
CPC ..... *C23C 24/04* (2013.01)
USPC ..... 427/201; 427/189; 427/422; 427/427.4; 428/402

(58) Field of Classification Search
USPC ..... 427/189, 422, 427.4; 428/402
See application file for complete search history.

(56) References Cited

U.S. PATENT DOCUMENTS 3,617,358 A * 11/1971 Dittrich ..... 427/447
6,531,187 B2 3/2003 Akedo (Continued)

FOREIGN PATENT DOCUMENTS

JP 2001-3180 1/2001
JP 2003-277948 10/2003

(Continued)

OTHER PUBLICATIONS

Kawakita et al., "(571) Densification of Titanium Coating by Warm Spray Using Bimodal Particles," Collected Abstracts of the 2006 Autumn Meeting (139th) of the Japan Institute Metals, published on Sep. 16, 2006 (with partial English translation).

(Continued)

*Primary Examiner* — Frederick Parker
(74) *Attorney, Agent, or Firm* — Wenderoth, Lind & Ponack, L.L.P.

(57) ABSTRACT

A coating method of the invention is characterized by using particles each being an aggregate comprising particles far smaller than that, and heating them at a temperature lower than the melting point and blowing and depositing the same to an object to be treated at a supersonic velocity. The warm spray of the invention is characterized in that standard particles and addition particles with a particle diameter larger than that are mixed so that the K-value determined by the following relation is 1 or more and 2 or less: K=A×(B/C)×D, A: mass % of the content of additive particles, B: center particle diameter of standard particle (μm), C: center particle diameter of additive particle (μm), D: (maximum particle diameter−minimum particle diameter) of additive particle/10 (μm). The invention intends to deposit micro oxide crystals without using an adhesive or the like, with no alteration to the function thereof, and also attain a dense layer with no substantial voids.

5 Claims, 22 Drawing Sheets

(56) References Cited

U.S. PATENT DOCUMENTS

| | | | | |
|---|---|---|---|---|
| 2001/0019742 | A1* | 9/2001 | Itsukaichi et al. | 427/453 |
| 2002/0018902 | A1 | 2/2002 | Tsukatani et al. | |
| 2004/0043230 | A1* | 3/2004 | Hatono et al. | 428/458 |
| 2006/0108031 | A1 | 5/2006 | Haynes | |
| 2006/0141144 | A1 | 6/2006 | Hatono et al. | |
| 2006/0213326 | A1* | 9/2006 | Gollob et al. | 75/252 |

FOREIGN PATENT DOCUMENTS

| | | |
|---|---|---|
| JP | 2005-97747 | 4/2005 |
| JP | 2005-314801 | 11/2005 |
| JP | 2005-344171 | 12/2005 |
| JP | 2006-183135 | 7/2006 |
| JP | 2006-249461 | 9/2006 |

OTHER PUBLICATIONS

Kawakita et al., "Full-Time Photocathode Corrosion Prevention Coating Using Warm Spray," Japan Society of Corrosion Engineering, Proceedings of the 53rd Japan Conference on Materials and Environments, published Sep. 15, 2006 (with English translation).

International Search Report issued Nov. 13, 2007 in European Application No. PCT/JP2007/067998.

Collected Abstracts of the 2006 Autumn Meeting (136th) of the Japan Institute Metals, published on Sep. 16, 2006.

* cited by examiner

Melted area

WARM SPRAY COATING METHOD AND PARTICLES USED THEREFOR

This application is a U.S. national stage of International Application No. PCT/JP2007/067998 filed Sep. 14, 2007.

TECHNICAL FIELD

The present invention concerns a warm spray coating method of depositing particles to the surface of an object to be treated and particles used therefor.

BACKGROUND ART

As a method of depositing material particles having various functions to the surface of an object to be treated, a method of interposing an adhesive, a method of coating in the form of a paint, etc. have been known. However, in the methods described above, functional material particles are eventually covered by the adhesive, for example, to result in hindrance of the function at the surface thereof.

For instance, a catalyst or the like can provide a function efficiently by making the particles of crystal as fine as the material particle. However, most of them are buried in the adhesive, causing functional failure in the methods described above.

Accordingly, there has been a need for technical means capable of depositing fine material particles, for example, oxide crystals with no alteration for the function thereof, without using the adhesive or the like.

On the other hand, as a method of depositing various kinds of material particles to the surface of an object to be treated, a warm spray method of heating particles to a temperature lower than the melting point thereof and depositing them by blowing at a supersonic velocity has been known. According to the warm spray method of the type described above, since the modification of the surface of the object to be treated can be completed by blowing and depositing the particles to the objective, the method has attracted attention due to the superiority in view of various operations, for example, that the modification operation can be done in the field.

Then, also for the deposition of the functional material particles, it may be considered to apply a coating method by warm spray. However, deposition of the particles by the warm spray method with no alteration in the functionality has not been considered.

As the specific subject of the coating method by warm spray, voids tend to be formed in a case of blowing particles and, accordingly, a device has been made for decreasing the particle diameter as small as possible. However, it has been found that limits are imposed on the fineness of the particle diameter due to a jet pressure upon spraying.

Accordingly, there has been a need for technical means of overcoming limitations on the particle diameter and forming a dense layer with no substantial voids.

DISCLOSURE OF THE INVENTION

Subject to be Solved by the Invention

With the background as described above, the present invention has a subject of overcoming the problems in the prior art and providing new technical means capable of depositing functional material particles to the surface of an object to be treated with no substantial alteration in the functionality and, particularly, realizing the same by the warm spray method, and capable of attaining a dense layer with no substantial voids by the warm spray method while overcoming limitations on particle diameter.

Means for Solving the Subject

For attaining the subject described above, the invention has the following features. The warm spray coating method according to the invention is characterized in that a particle is an aggregate of fine particles with a particle diameter smaller than that of the particle, and heated to a temperature lower than the phase transition temperature thereof and blown and deposited at a supersonic velocity to an object to be treated.

The invention is further characterized in that the particle is formed by aggregating and solidifying micro particles to each other by a binder comprising an organic compound and in that the heating temperature upon blowing is at or higher than the sublimation temperature of the binder.

The invention is further characterized in that the micro particle comprises an oxide crystal.

Then, the invention is further characterized by the warm spray coating particle per se.

Further, the warm spray coating method according to the invention is characterized by using standard particles and additive particles with the particle diameter larger than that and mixing and blowing them such that a K value which is determined according to the following relation is 1 or more and 2 or less.

$$K=A\times(B/C)\times D$$

A: mass % of the content of additive particles

B: center particle diameter of standard particle (μm)

C: center particle diameter of additive particle (μm)

D: (maximum particle diameter−minimum particle diameter) of additive particle/10 (μm)

Another invention is a warm spray method according to the above characterized in that both the standard particle and the additive particle are formed of an identical kind of metal particles.

The method is further characterized in that at least one of the standard particle and the additive particle is an aggregate of fine particles with the diameter smaller than that of the particle diameter of each of them.

The method is further characterized in that the fine particle constituting the aggregate comprises an oxide crystal.

Further, the invention is characterized by the particle per se for warm spray coating.

Effect of the Invention

The method above is a novel warm spray method. Prior to this invention, the minimum value for the particle diameter of the particle that can be blown is restricted and blowing at a supersonic velocity is impossible above a minimum particle size.

However, according to the present invention, even a fine particle of less than sub-micron size can also be blown and deposited to an object to be treated.

Further, since the binder is sublimated or vaporized during flying, this avoids having fine particles covered by the adhesive failing to provide expected functions.

Further, in the present invention the crystal in a fine particulate form can be deposited with no denaturation and the function thereof can be maximized on the surface of an object to be treated.

Further, according to the invention, a remarkably dense layer (film) is formed. Addition per se of a slight amount of large sized particles was avoided as deteriorating the denseness in the prior art and in view of the existent technical common knowledge. The addition of such particles in this invention with a remarkably resultant dense layer is an effect quite contrary to the existent technical common knowledge.

Figure 1:
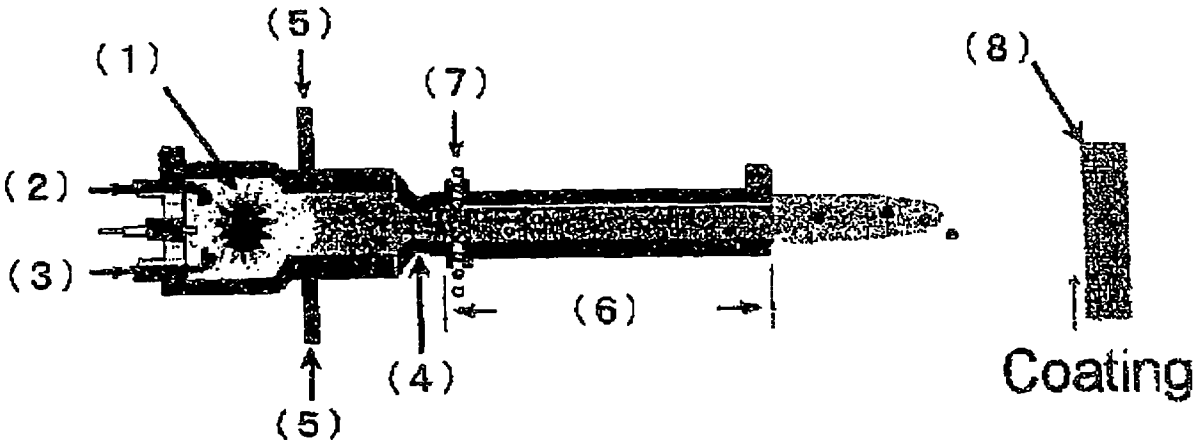
FIG. 1 is a schematic view showing the structure of a spray apparatus used in the present method.
Figure 2:
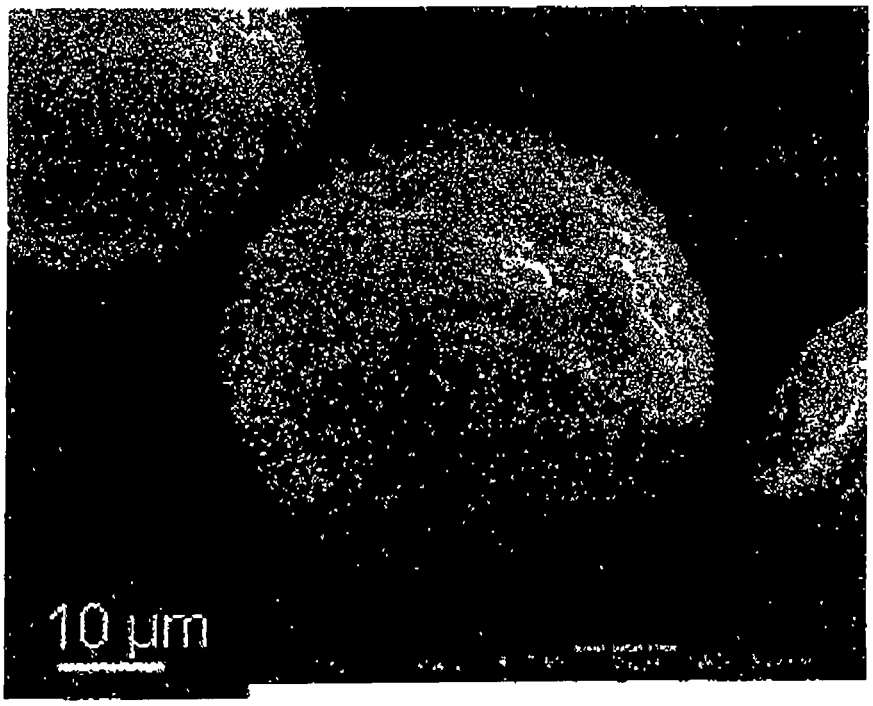
FIG. 2 is a microscopic photograph for a particle used in Experiment No. 2 of Example A.
Figure 3:
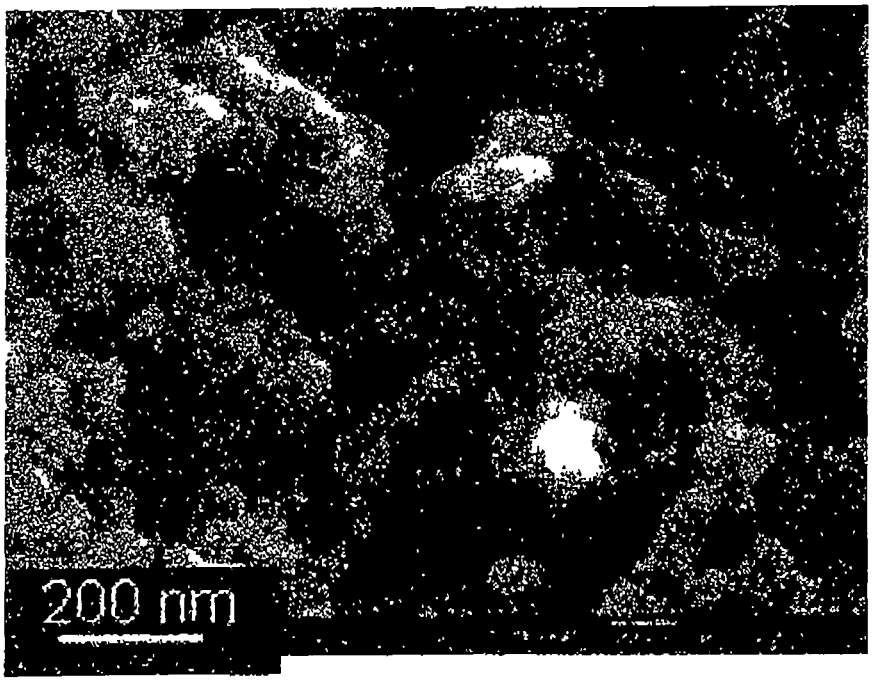
FIG. 3 is an enlarged photograph for the cross section of the particle shown in FIG. 2.
Figure 4:
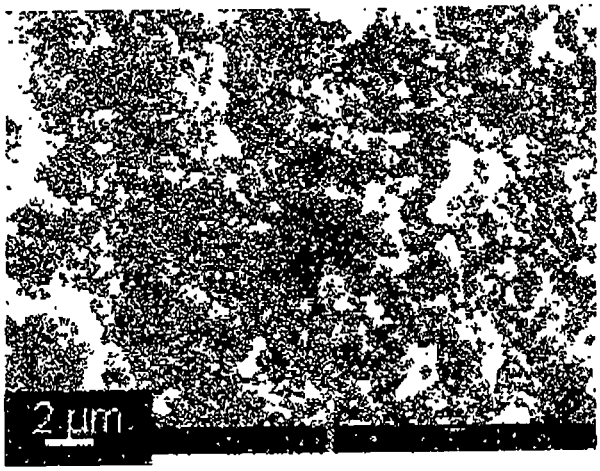
FIG. 4 is an enlarged photograph for the surface of a coating layer in an example.
Figure 5:
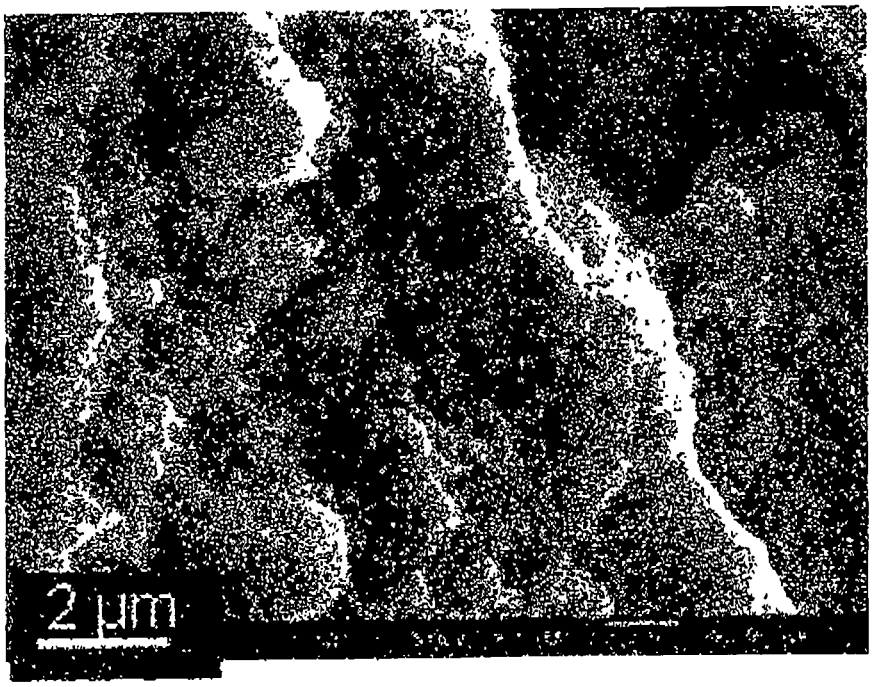
FIG. 5 is an enlarged photograph for the side elevation of the coating layer shown in FIG. 4.
Figure 6:
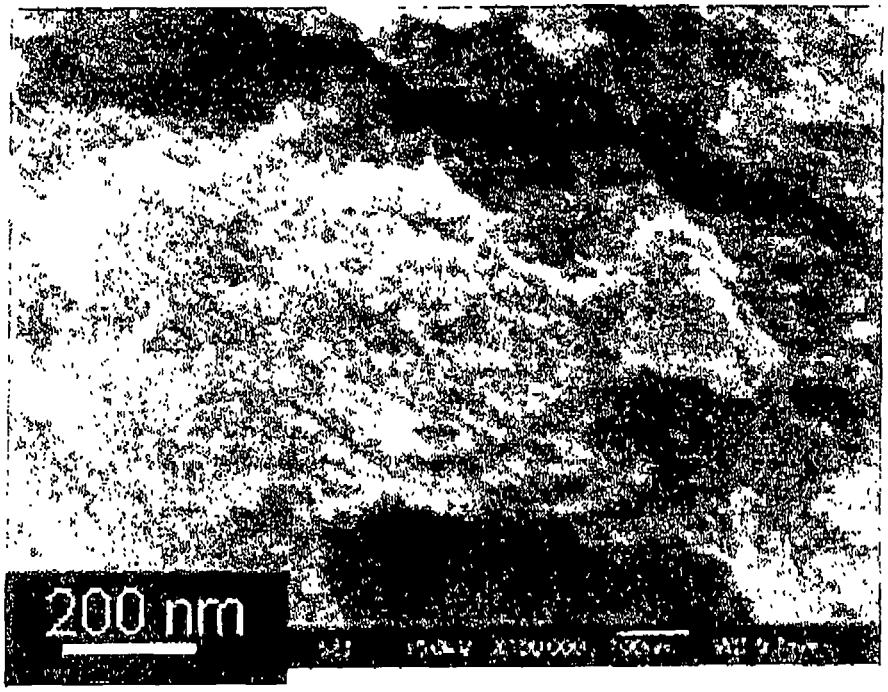
FIG. 6 is an enlarged photograph enlarging a portion of FIG. 5.
Figure 7:
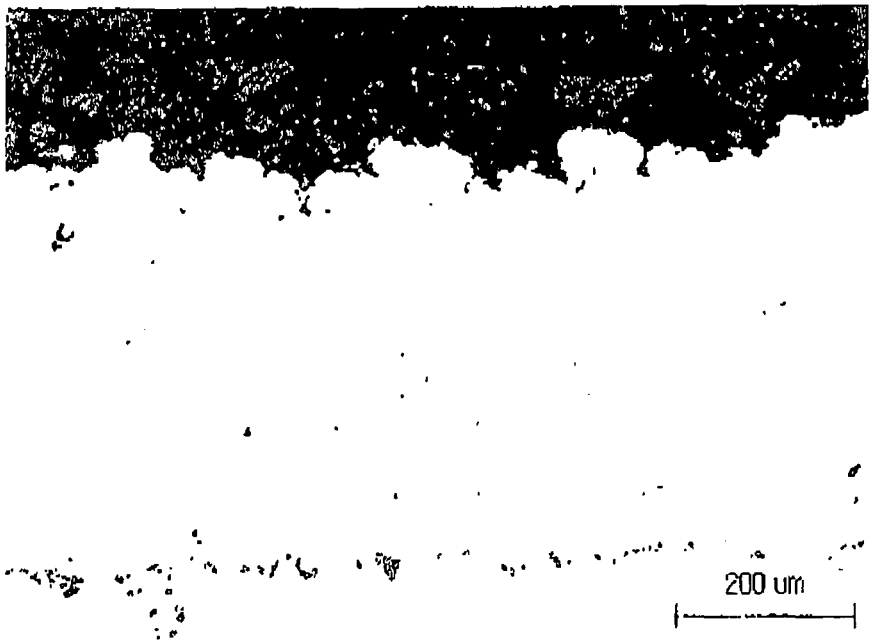
FIG. 7 is a photograph for the cross section of a coating layer according to Experiment No. 1.
Figure 8:
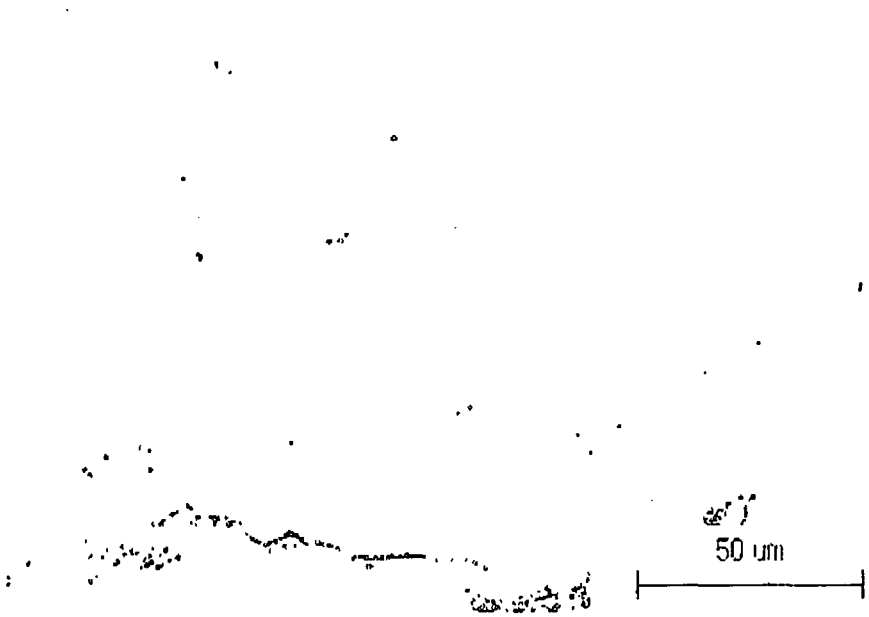
FIG. 8 is an enlarged photograph by 4× for the cross section of the coating layer according to Experiment No. 1.
Figure 9:
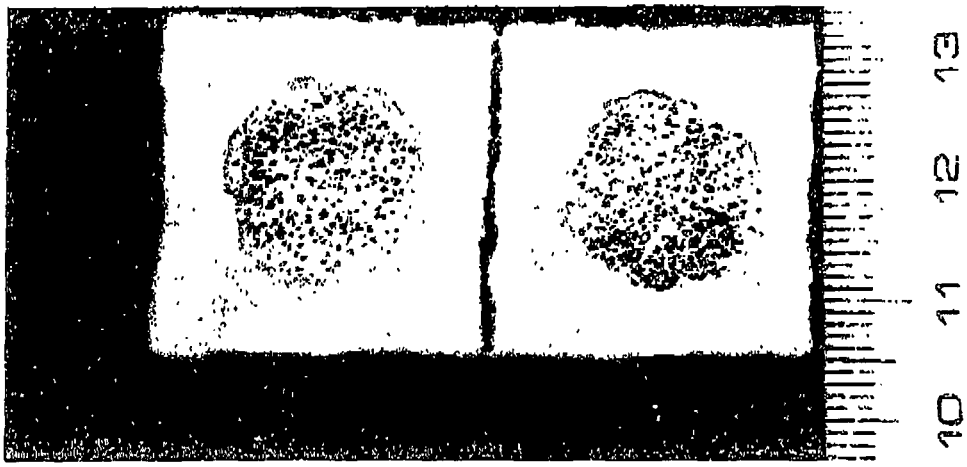
FIG. 9 is a photograph showing the result of a salt water immersion test for a sample in Experiment No. 1.
Figure 10:
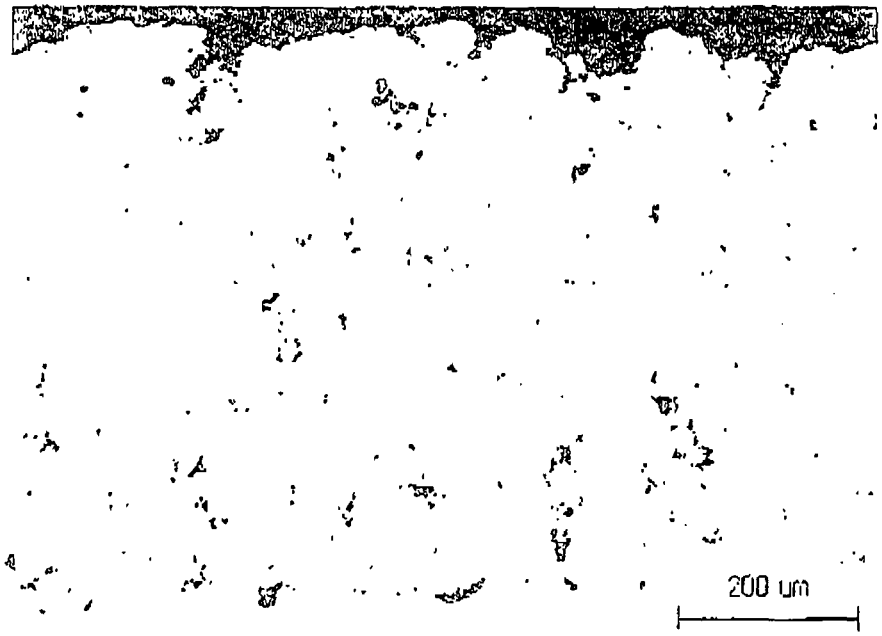
FIG. 10 is an photograph for the cross section of a coating layer according to Experiment No. 2.
Figure 11:
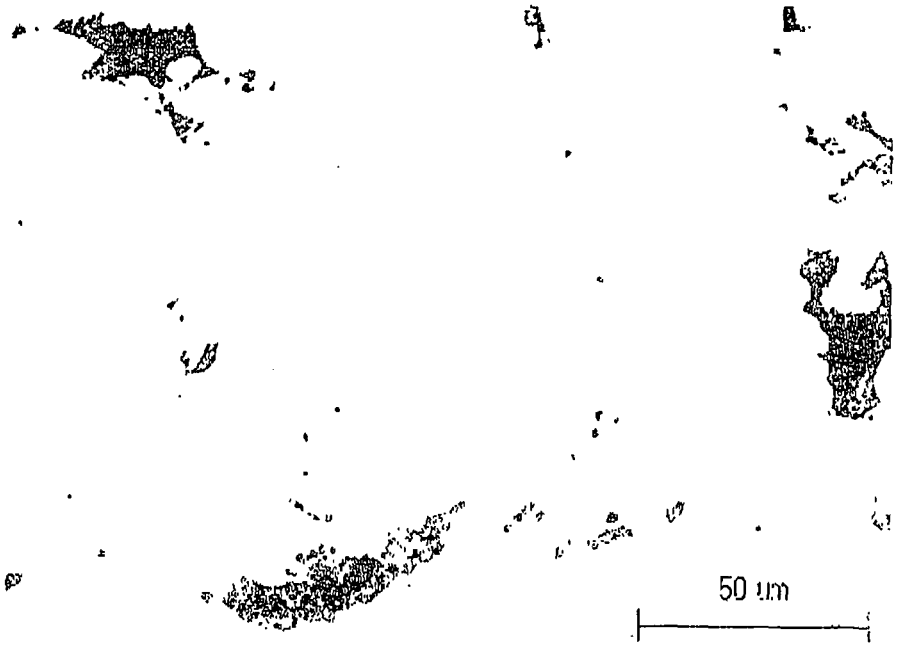
FIG. 11 is an enlarged photograph by 4× for the cross section of the coating layer according to Experiment No. 2.
Figure 12:
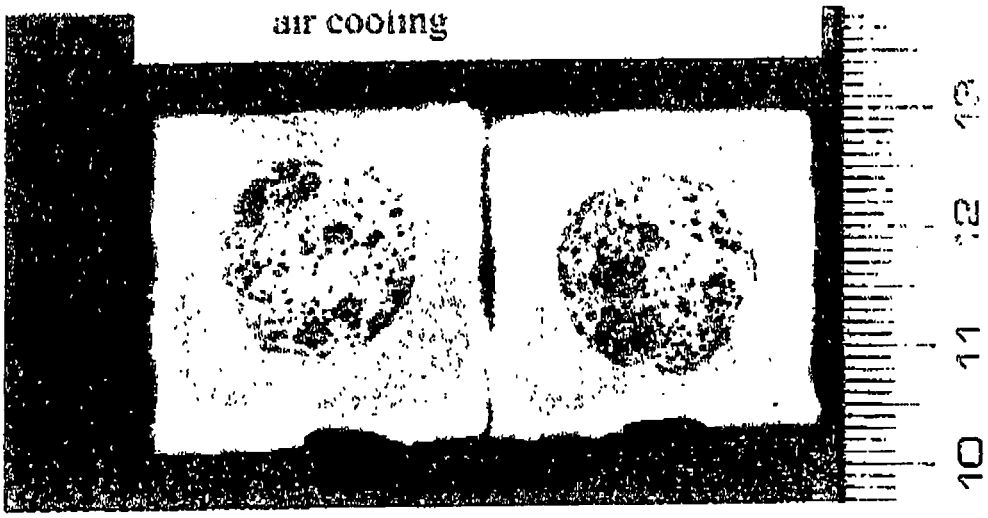
FIG. 12 is a photograph showing the result of a salt water immersion test for a sample in Experiment No. 2.
Figure 13:
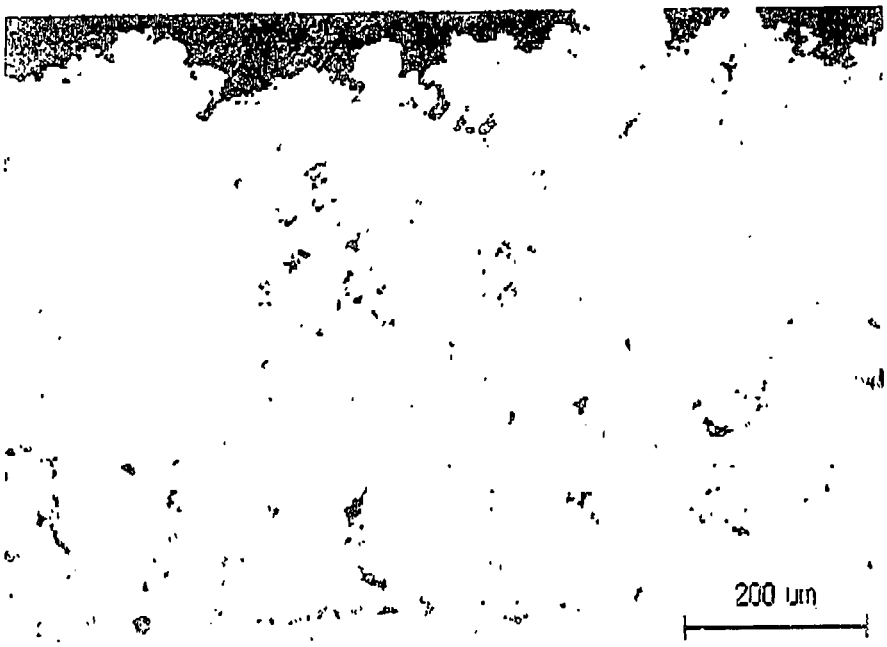
FIG. 13 is a photograph for the cross section of a coating layer according to Experiment No. 3.
Figure 14:
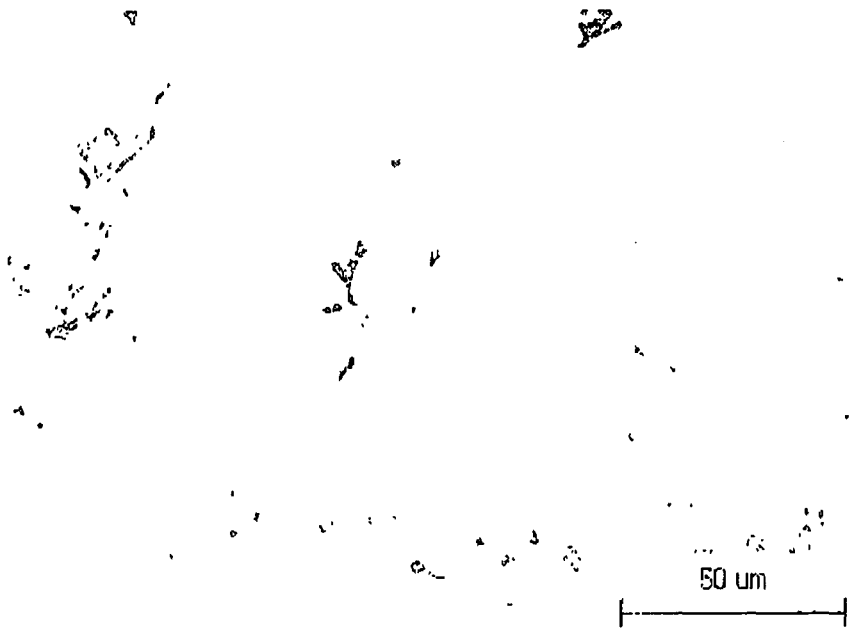
FIG. 14 is an enlarged photograph by 4× for the cross section of the coating layer according to Experiment No. 3.
Figure 15:
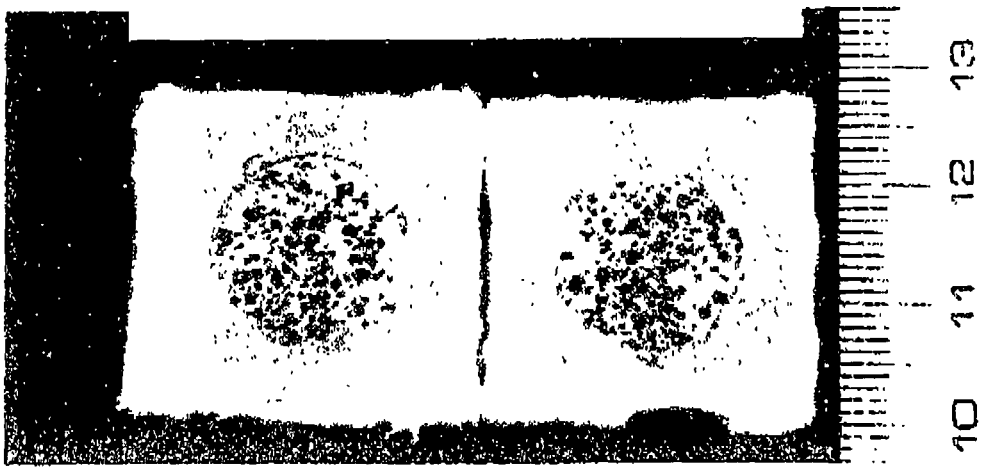
FIG. 15 is a photograph showing the result of a salt water immersion test for a sample in Experiment No. 3.
Figure 16:
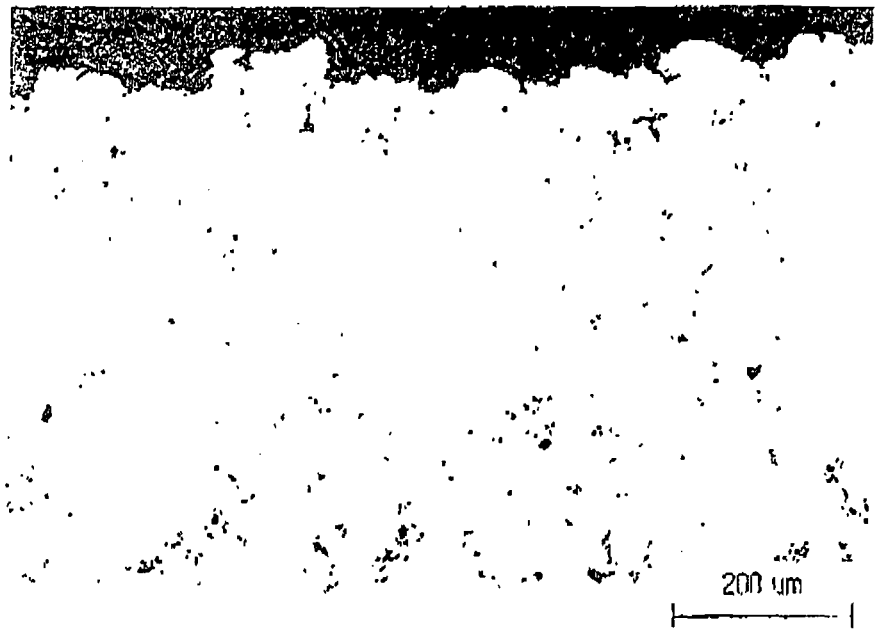
FIG. 16 is an photograph for the cross section of a coating layer according to Experiment No. 4.
Figure 17:
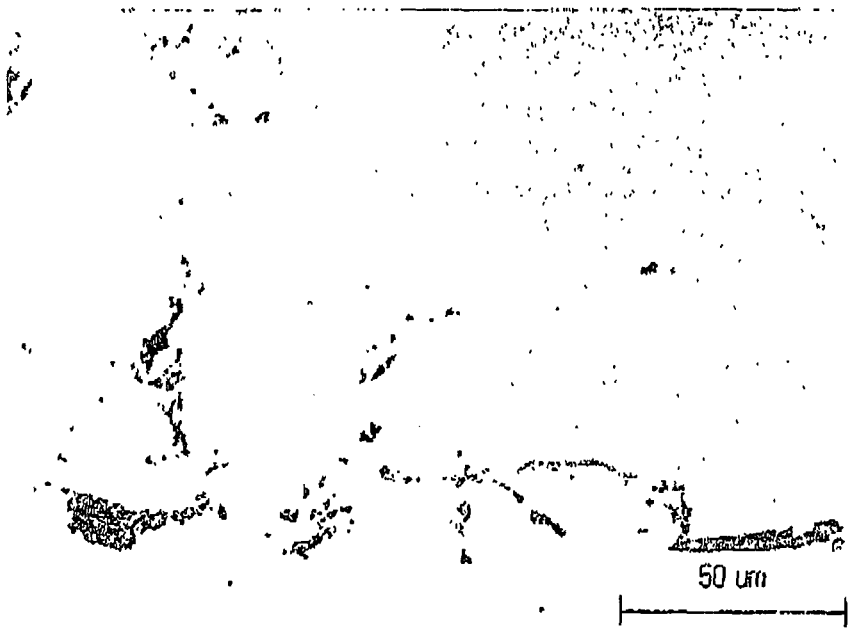
FIG. 17 is an enlarged photograph by 4× for the cross section of the coating layer according to Experiment No. 4.
Figure 18:
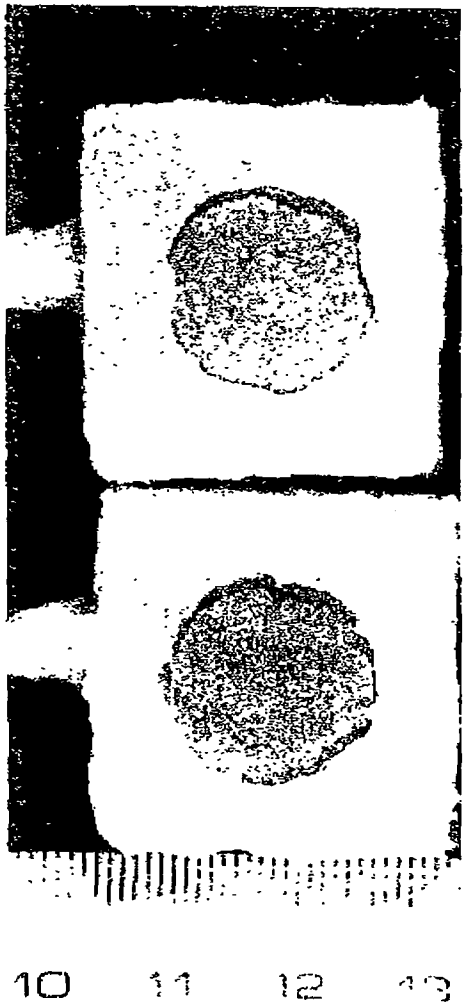
FIG. 18 is a photograph showing the result of a salt water immersion test for a sample in Experiment No. 4.
Figure 19:
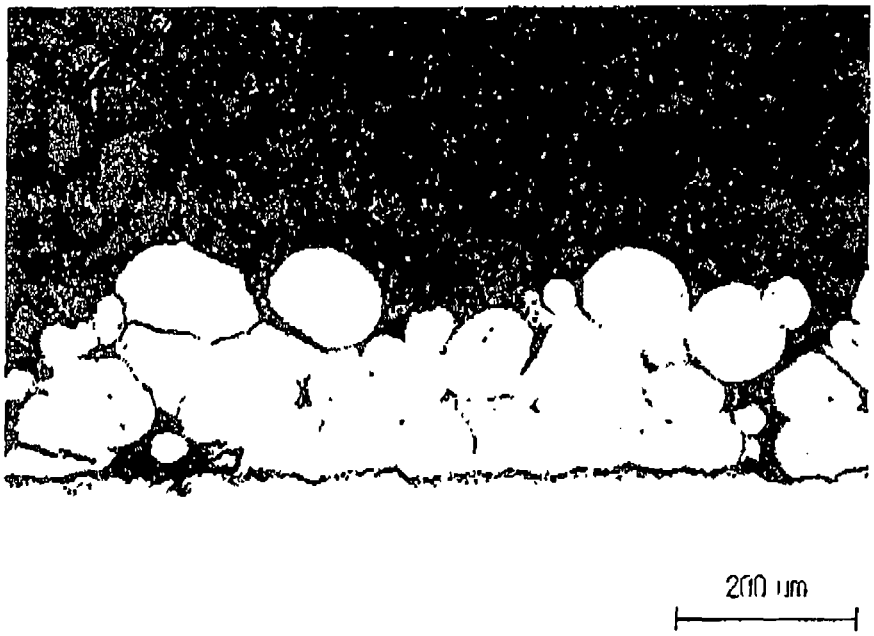
FIG. 19 is a photograph for the cross section of a coating layer according to Experiment No. 5.
Figure 20:
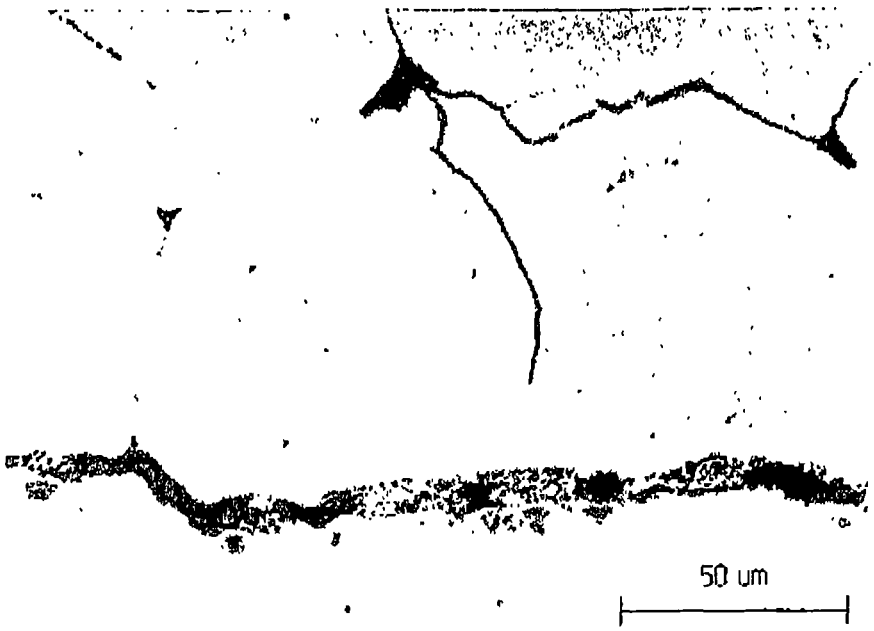
FIG. 20 is an enlarged photograph by 4× for the cross section of the coating layer according to Experiment No. 5.
Figure 21:
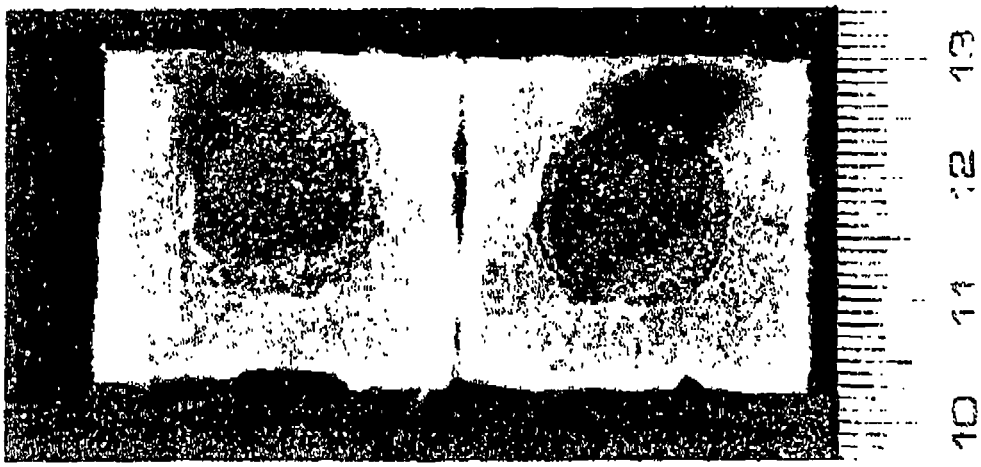
FIG. 21 is a photograph showing the result of a salt water immersion test for a sample in Experiment No. 5.
Figure 22:
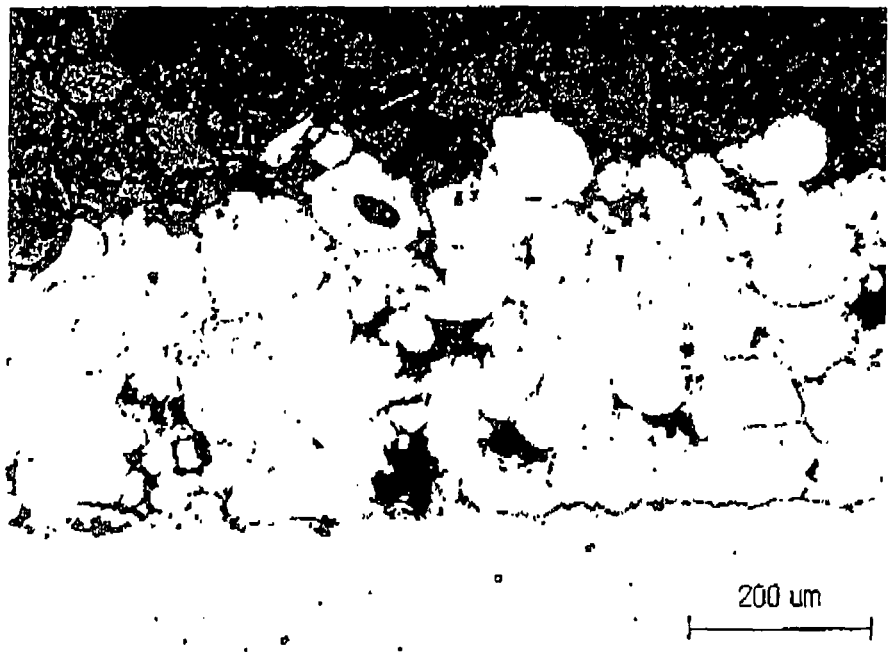
FIG. 22 is a photograph for the cross section of a coating layer according to Experiment No. 6.
Figure 23:
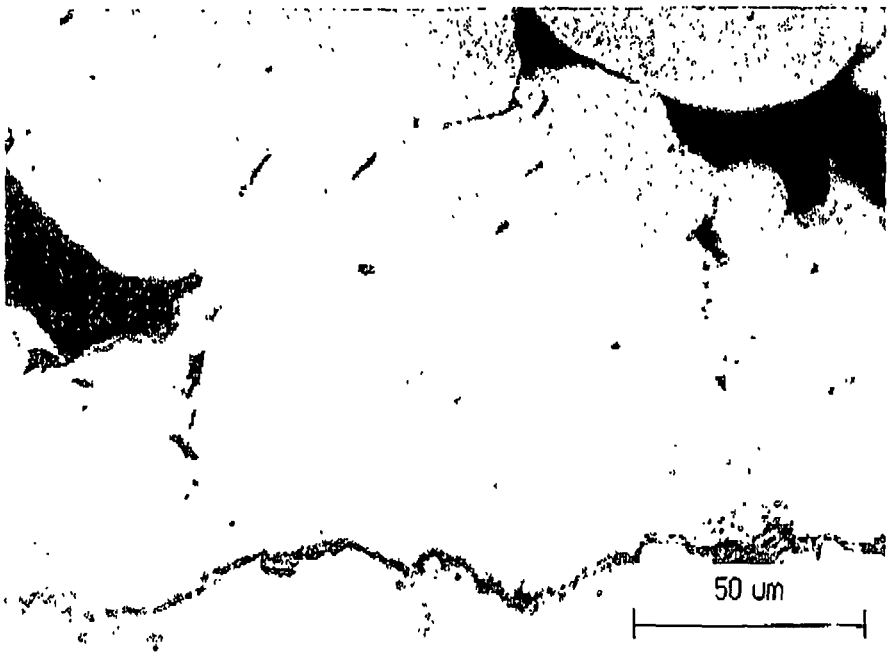
FIG. 23 is an enlarged photograph by 4× for the cross section of the coating layer according to Experiment No. 6.
Figure 24:
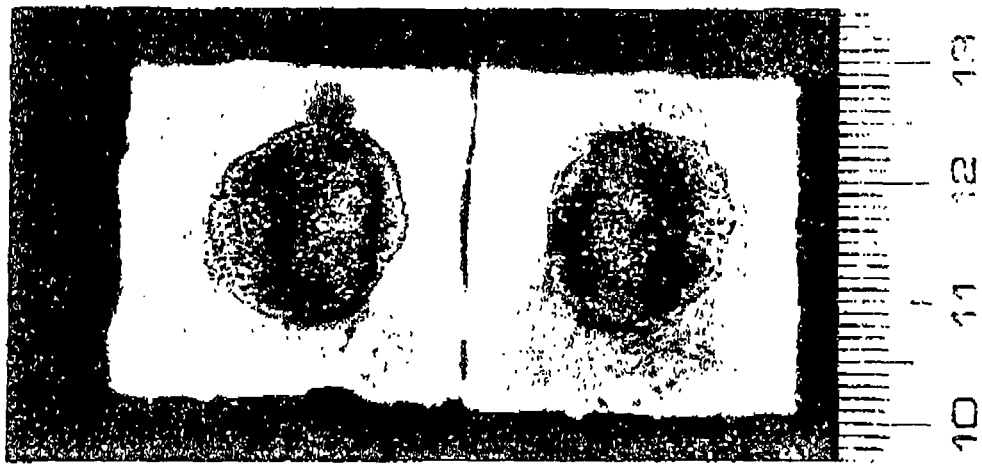
FIG. 24 is a photograph showing the result of a salt water immersion test for a sample in Experiment No. 6.
Figure 25:
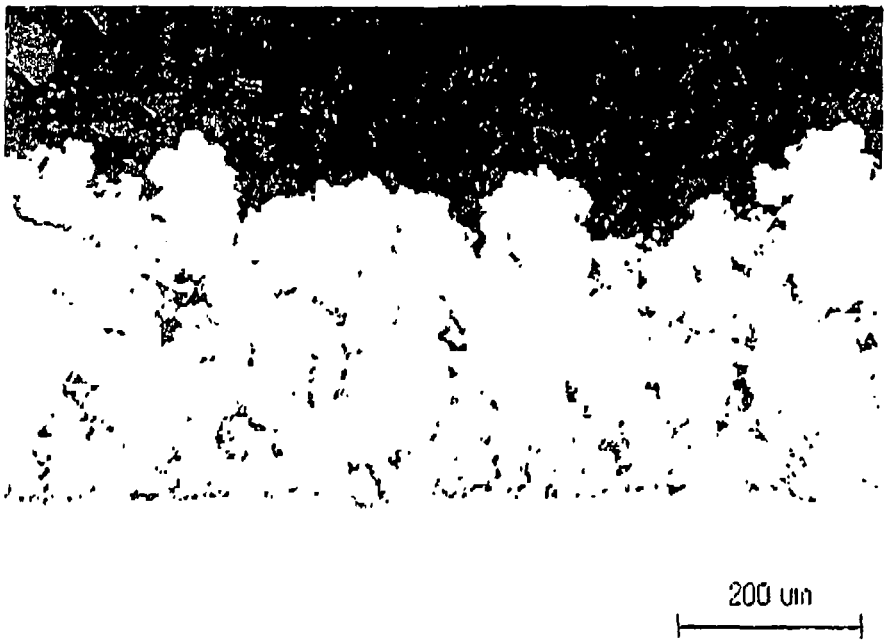
FIG. 25 is a photograph for the cross section of a coating layer according to Experiment No. 7.
Figure 26:
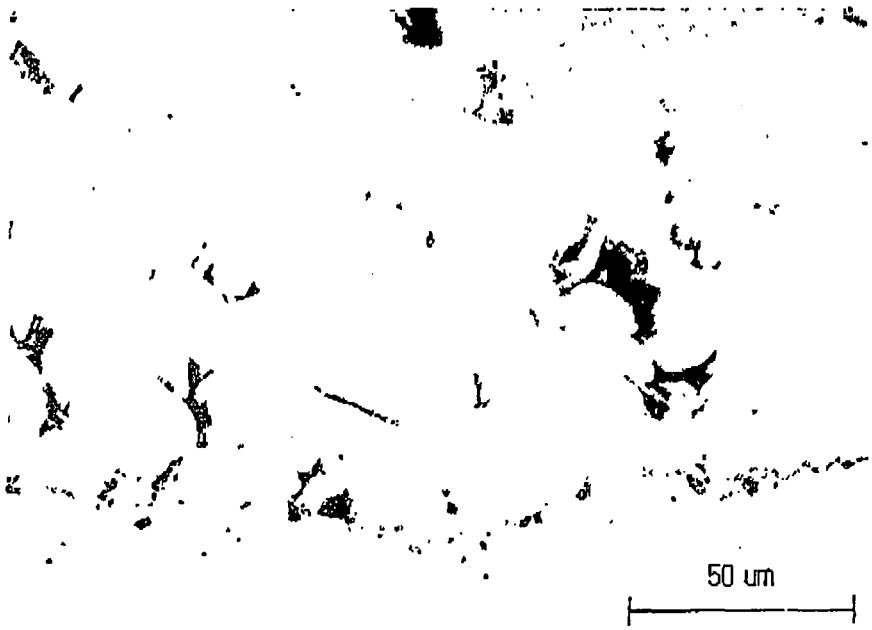
FIG. 26 is an enlarged photograph by 4× for the cross section of the coating layer according to Experiment No. 7.
Figure 27:
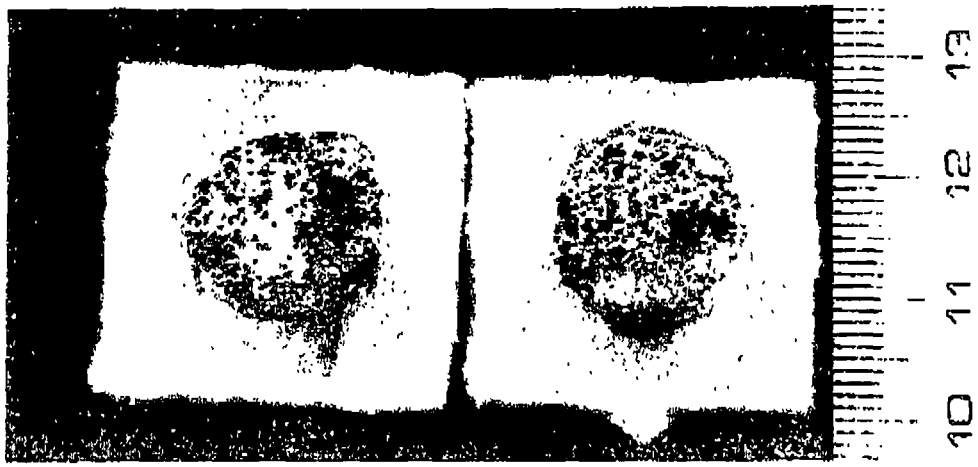
FIG. 27 is a photograph showing the result of a salt water immersion test for a sample in Experiment No. 7.
Figure 28:
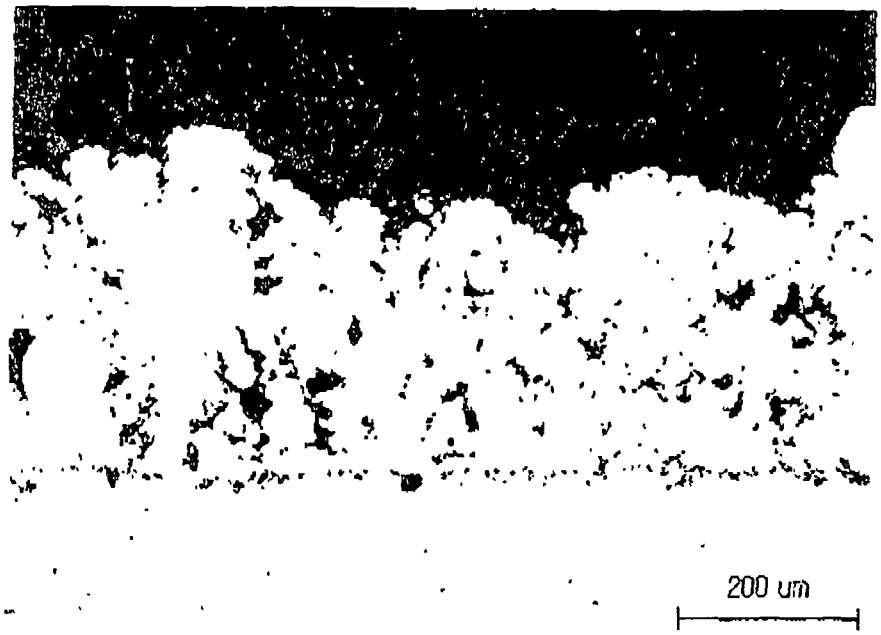
FIG. 28 is a photograph for the cross section of a coating layer according to Experiment No. 8.
Figure 29:
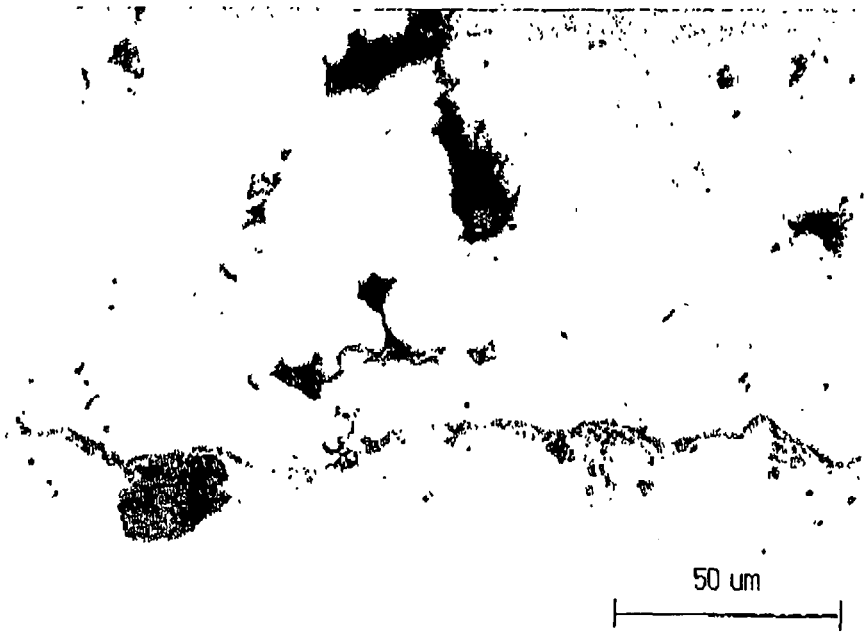
FIG. 29 is an enlarged photograph by 4× for the cross section of the coating layer according to Experiment No. 8.
Figure 30:
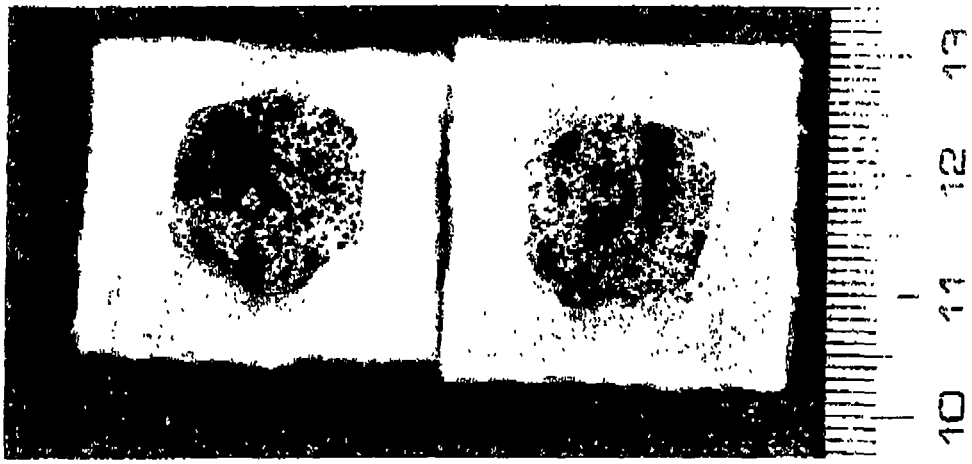
FIG. 30 is a photograph showing the result of a salt water immersion test for a sample in Experiment No. 8.
Figure 31:
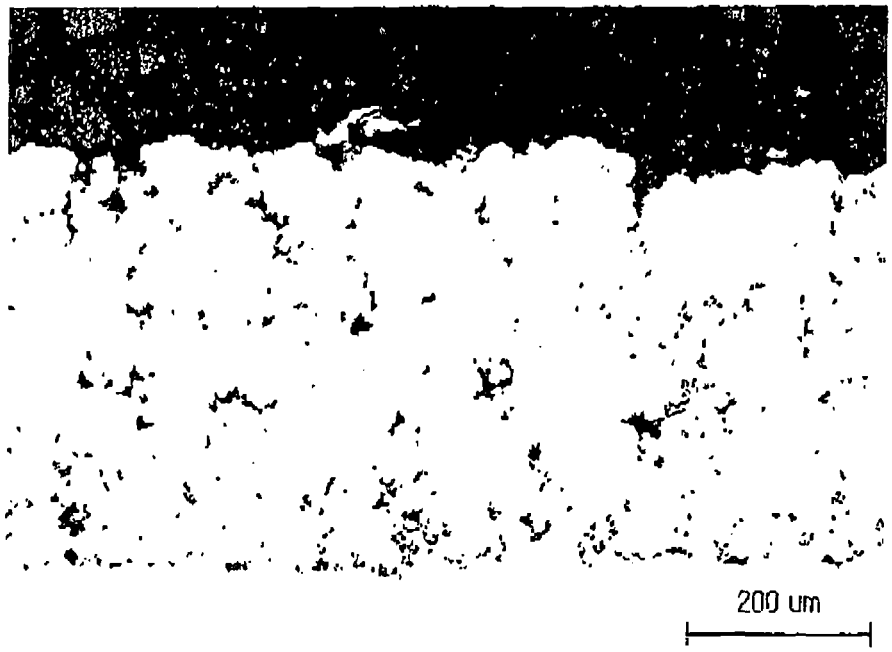
FIG. 31 is a photograph for the cross section of a coating layer according to Experiment No. 9.
Figure 32:
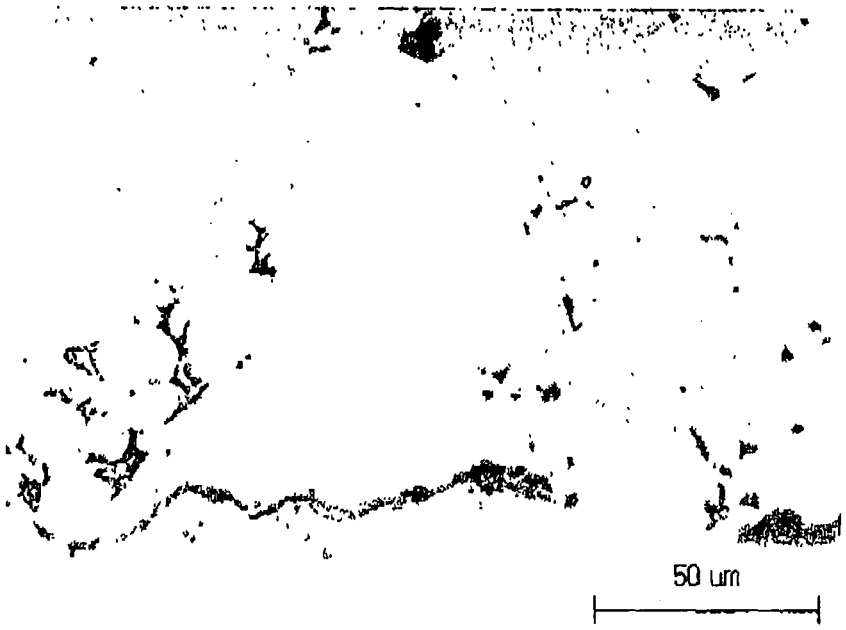
FIG. 32 is an enlarged photograph by 4× for the cross section of the coating layer according to Experiment No. 9.
Figure 33:
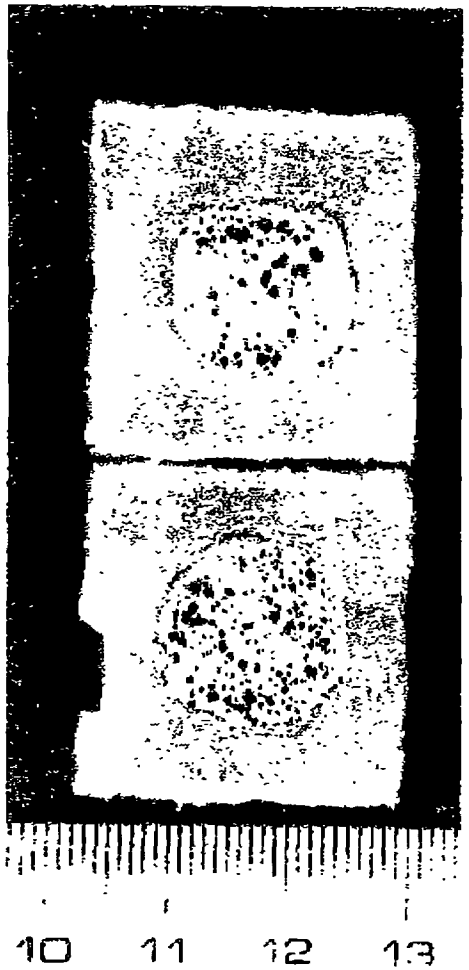
FIG. 33 is a photograph showing the result of a salt water immersion test for a sample in Experiment No. 9.
Figure 34:
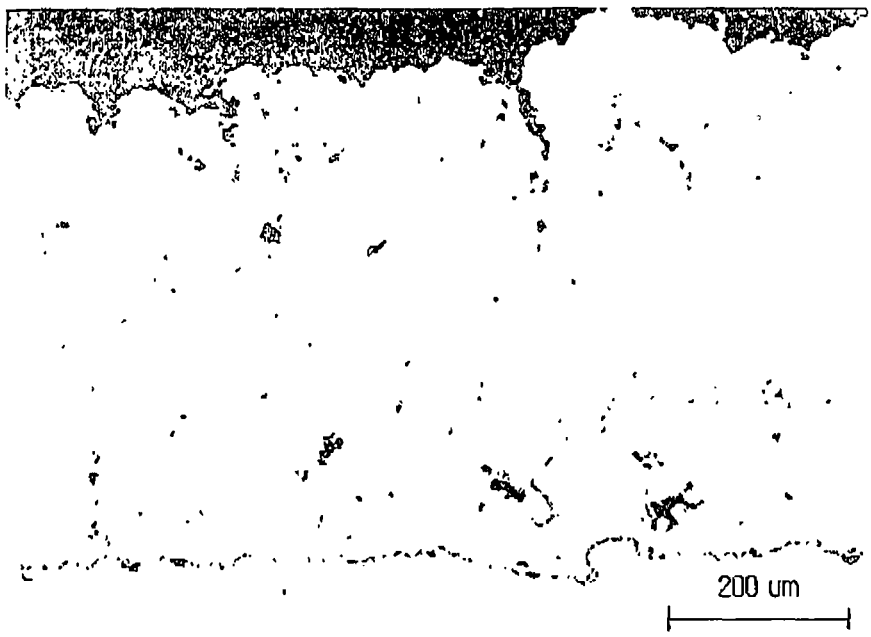
FIG. 34 is a photograph for the cross section of a coating layer according to Experiment No. 10.
Figure 35:
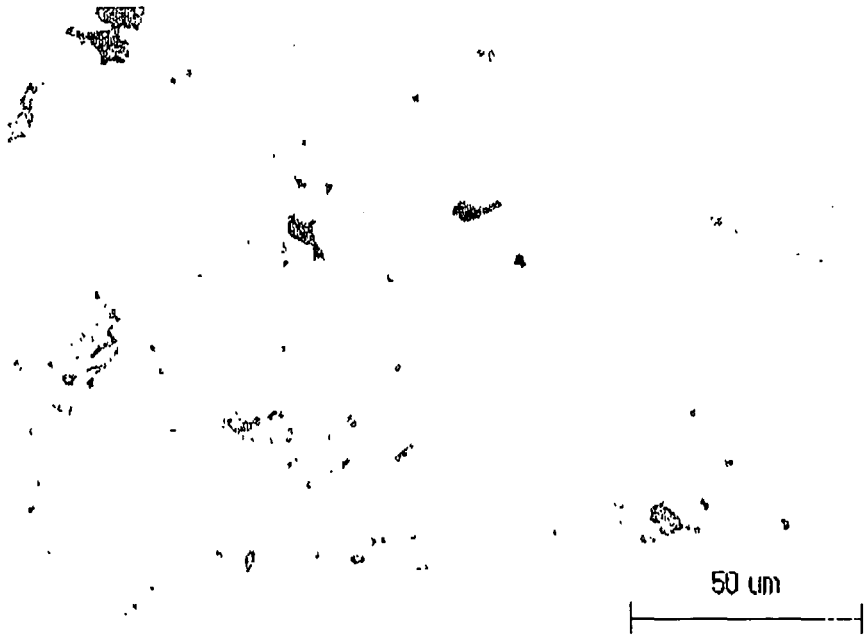
FIG. 35 is an enlarged photograph by 4× for the cross section of the coating layer according to Experiment No. 10.
Figure 36:
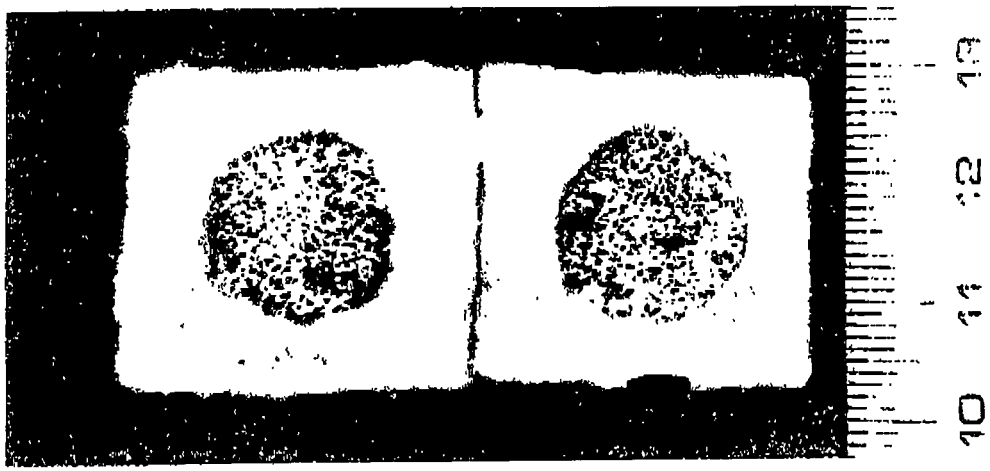
FIG. 36 is a photograph showing the result of a salt water immersion test for a sample in Experiment No. 10.
Figure 37:
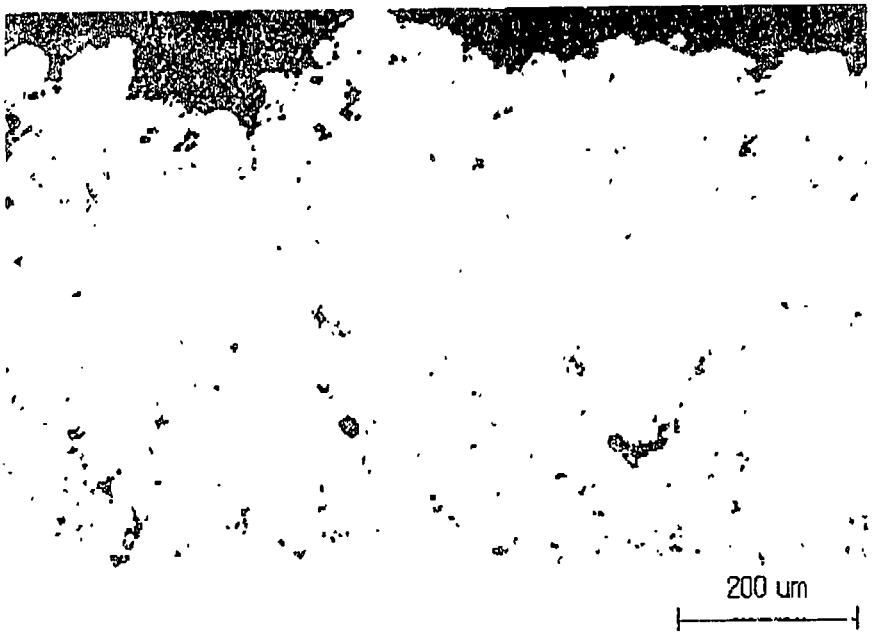
FIG. 37 is a photograph for the cross section of a coating layer according to Experiment No. 11.
Figure 38:
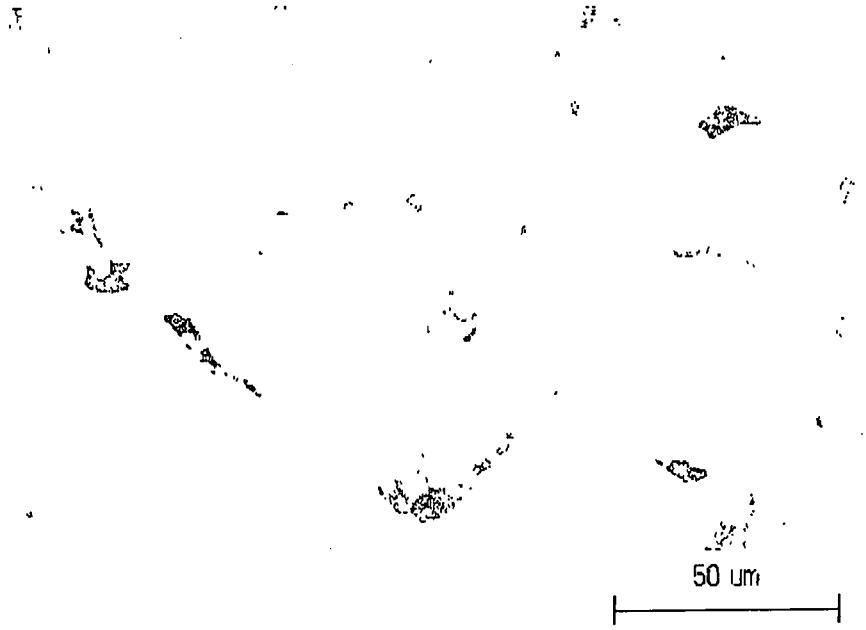
FIG. 38 is an enlarged photograph by 4× for the cross section of the coating layer according to Experiment No. 11.
Figure 39:
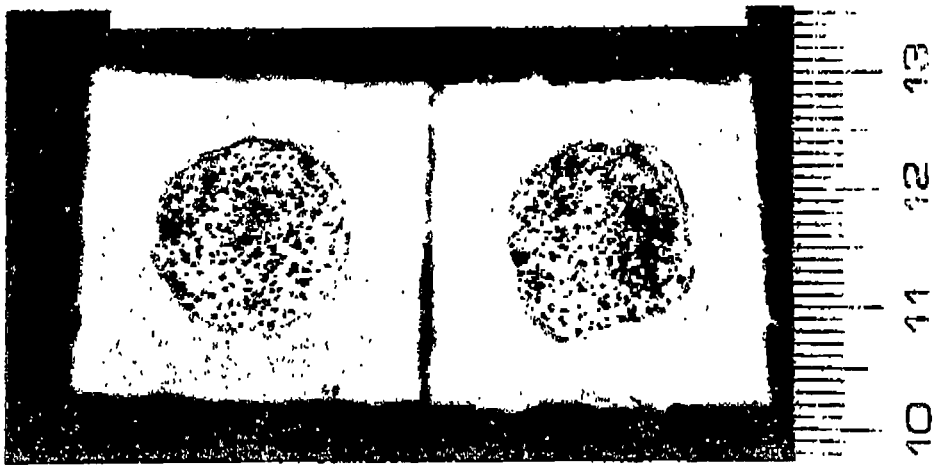
FIG. 39 is a photograph showing the result of a salt water immersion test for a sample in Experiment No. 11.
Figure 40:
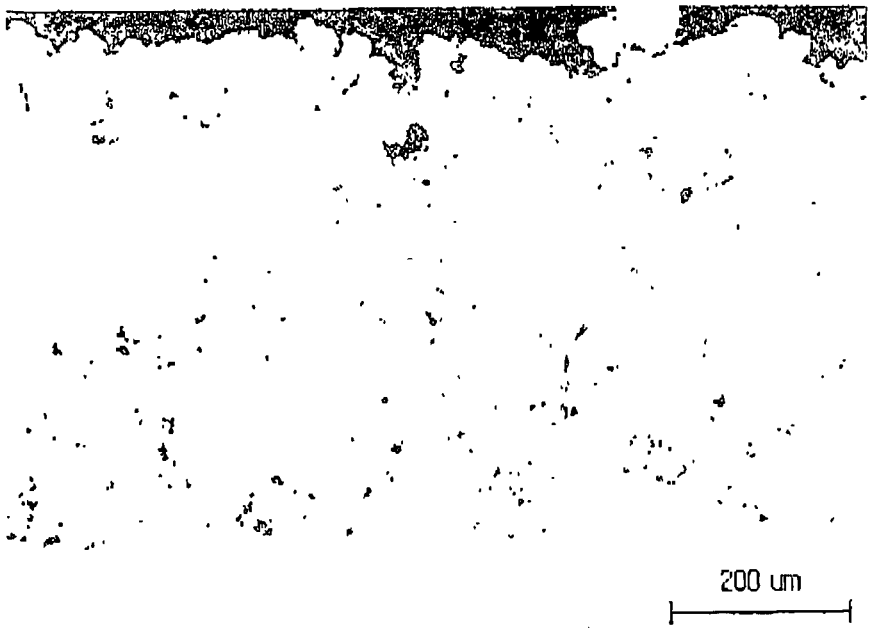
FIG. 40 is a photograph for the cross section of a coating layer according to Experiment No. 12.
Figure 41:
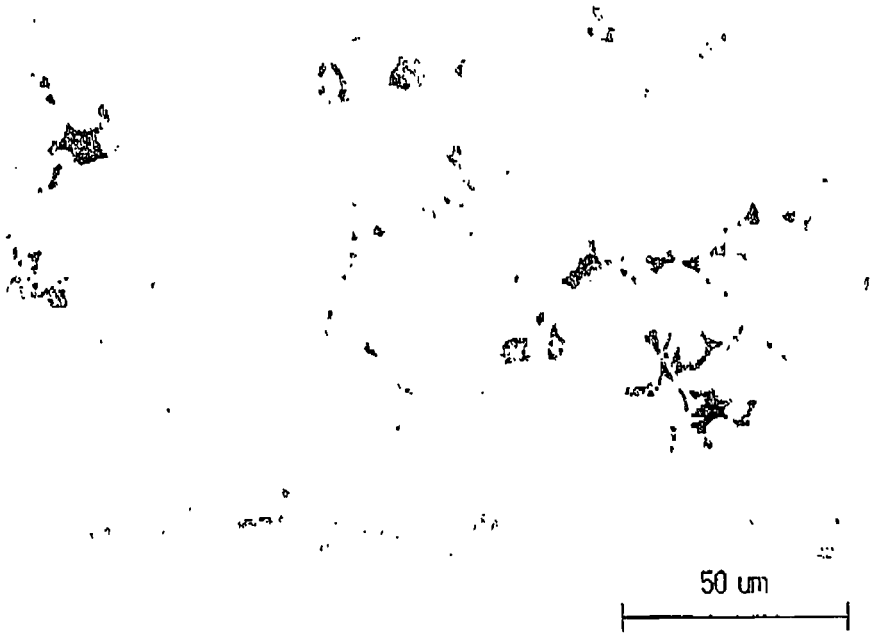
FIG. 41 is an enlarged photograph by 4× for the cross section of the coating layer according to Experiment No. 12.
Figure 42:
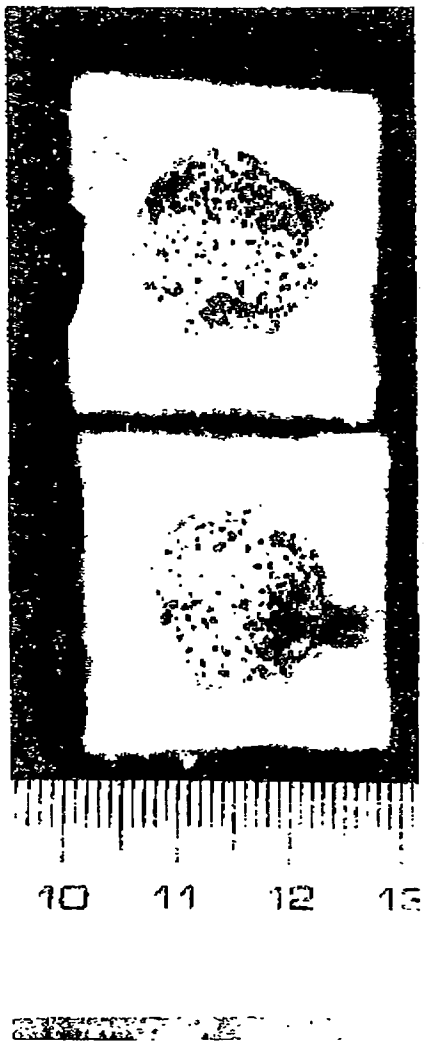
FIG. 42 is a photograph showing the result of a salt water immersion test for a sample in Experiment No. 12.

DESCRIPTION FOR REFERENCES (1) combustion chamber
(2) fuel supply port
(3) oxygen supply port
(4) nozzle
(5) inert gas supply port
(6) barrel
(7) particle charging port
(8) object to be treated

BEST MODE FOR CARRYING OUT THE INVENTION

The invention described above concerns a warm spray coating method using particles each comprising an aggregate of fine particles of smaller particle diameter, and the particle therefor. The warm spray coating method in this case includes, as fundamental constitutional factors;

<1> using an aggregate of a fine particle comprising fine particles of smaller particle diameter, for example, fine particles of oxide crystals, metals, alloys, and ceramics, as the particle used for spraying, and <2> heating the aggregate to a temperature lower than the phase transition temperature of the particle, as described above. In the warm spring coating of the invention, the particles described above are blown at a supersonic velocity to an object to be treated.

For the constitutional factor <1>, the particle diameter for the fine particle and the aggregate thereof may be optional and can be set corresponding to the purpose, the application use, and the function of an object to be treated, that is, a substrate or a film blown to the substrate, as well as the scale of the apparatus and the operation conditions for warm spray.

For example, an aggregate particle may have a particle diameter which is larger by 10 times to 1000 times than the particle diameter of fine particle. For example, an aggregate particle having a particle diameter of 10 μm to 100 μm may form from fine particles having a particle diameter of 10 to 1000 nm.

The particles as the aggregate can be controlled within a range of required particle diameter by using a device such as a vibration sieve. There are various methods for forming aggregates of fine particles. For example, a binder of an organic compound or inorganic material may be used, or it forming an aggregate by electrostatic attraction and then effecting firing, etc.

As a method capable of forming the aggregate simply and conveniently with no substantial effects on the blown film, using a binder of an organic compound is considered appropriate. In this case, the sublimation temperature or vaporization temperature of the organic compound as the binder is preferably at or lower than the heating temperature upon warm spray.

For the organic compound as the binder, it may be considered to use, for example, various types of synthetic polymeric binders such as polyvinyl alcohol (PVA), acrylic type, polyester type or polyurethane type, or natural or semi-synthetic binder comprising starch or the like.

The amount of the binder may be such that the aggregate comprising the fine particles can be formed and the particle shape can be retained upon supply to the form spray apparatus. The amount may be a minimum amount. The aggregate can be formed by mixing the fine particles with the binder described above and pelleting them by heating or drying. In this case, a spray-dry method or the like may be optionally adopted.

The definition of "lower than phase transition temperature" for the heating temperature of the constitutional factor <2> means that it is lower than "phase transition temperature" defined as a temperature upon transition from thermodynamic low temperature stable phase to high temperature stable phase. For example, in a case of titanium oxide "phase transition temperature" is 1000 k or higher.

For the heating at "lower than the phase transition temperature", since the staying time of the particles as a target in the jet of the warm spray is usually as short as 1 ms or less, even when the jet temperature is above "phase transition temperature" as the measured value, the heating temperature for the particle does not reach "phase transition temperature".

Specific heat or heat conductivity of the particle may be taken into consideration.

In a case of titanium oxide, for example, the jet temperature is lower than 1600 k.

The outline for the warm spray method itself is known and the invention can be practiced based on such knowledge.

For example, FIG. 1 shows an outline of a warm spray gun used in practicing the invention, which has a fuel supply port (2) and an oxygen supply port (3) for adding fuel and oxygen under pressure into a combustion chamber (1), in which a port (5) for supplying an inert gas to the combustion chamber (1) is disposed near a nozzle (4), which is the exit of the combustion chamber (1). As described above, the gun is adapted such that the supply of oxygen and fuel is increased or decreased in an inverse proportion to the increase and decrease of the inert gas under pressure, and the temperature can be controlled within a range from $4\times10^2$ to $25\times10^{2\circ}$ C. while keeping the gas jetting speed from the nozzle (4) relatively constant.

Further, a cylindrical barrel (6) is connected coaxially to the exit of the nozzle (4) and a charging port (7) for charging particles is disposed near the end of the nozzle.

For example, a blowing at a supersonic velocity such that the colliding speed to an object is from 500 to 1300 m/s for the invention using the apparatus described above.

The colliding speed can be calculated as a fluid dynamic simulation and the speed can be attained by control of jetting speed and the distance between the exit of the spray nozzle and the object to be treated.

The warm spray coating at a supersonic velocity can be attained.

According to the inventions, a functional film can be formed by warm spray using particles as an aggregate without substantially deteriorating the functionality of fine particles thereof.

Further, the warm spray method and the particles used therefor in the present inventions include, as fundamental constitutional factors that particles comprise;

<1> standard particle, and

<2> additive particle with a diameter greater than that of the standard particle, as the particle and using both of the particles in admixture within such a specific range that the K value determined according to the relation as described above is 1 or more and 2 or less. A dense film can thus be formed easily.

"Standard particle" referred to herein may be particles of a particle diameter usually used for the flame spray method and easily available as commercial products. For example, in a case of titanium oxide, this may be considered that it comprises a particle with particle diameter of 45 μm or less.

"Additive particle", on the other side, is defined as having such a large particle diameter that is not usually used.

By mixing the additive particles of larger grain to the standard particles at a specific ratio, that is, by mixing them so as to obtain a K value of 1 or more and 2 or less, the denseness of the film is improved remarkably compared with a case of using only the standard particles.

For the denseness of the film, the denseness is high when the porosity P is low. As a method of measuring the porosity P, there is a method of packing mercury in pores and measuring the amount thereof. Alternatively, since it has been known that the porosity P is related with a value Rc by an electrochemical method (corrosion resistance), the Rc value used in the examples herein may be used as a measure of the porosity (denseness).

In the mixing of the standard particles and the additive particles, while they may be of kinds different from each other, it is preferred to use identical kind of particles, for example, metal particles of an identical kind with a view point of remarkable improvement of the denseness.

Further, a composite functionality may be attained together with improvement in the denseness by using plural kinds of additive particles to one kind of standard particle. Alternatively, it may also be considered that the standard particle comprises plural types and the additive particle comprises a single type or plural types.

Then, upon mixing described above, at least one of the standard particle and the additive particle may be an aggregate of fine particles with a diameter being smaller than that of each of the particles. According to this, denseness is improved and the functionality of the fine particle can be provided for the film with no substantial deterioration.

Also in the inventions, a warm spray apparatus having the constitution, for example, of FIG. 1 can be used. In the apparatus, it is preferred, for example, to control the oxygen concentration to 5 vol % or less in the gas during supply of the powder mixture and the gas temperature to 1500° C. or lower in a case of the metal particle, etc. Such temperature control can be effected by mixing an inert gas into a combustion gas.

Further, the colliding speed of the particle mixture to the object to be treated is preferably from 500 to 1300 m/s.

While the examples to be described later show the case of the Ti particle, this is not restrictive. In a case where the oxygen concentration exceeds 5 vol %, the gas temperature exceeds 1500° C., or the colliding speed is less than 500 m/s, it is difficult, for example, to suppress oxidation of Ti or obtain a dense structure. On the other hand, the lower limit of the oxygen concentration is desirably as low as possible as the oxygen content ratio after the combustion reaction of forming a high speed flame. The gas temperature dominates the heating state and the flow rate of particles, for example, of the Ti metal or alloy thereof. The lower limit varies, for example, depending on the scale of the apparatus, the amount of the powder to be supplied, the type of the powder, for example, metals such as Ti, as well as Mn, Sn, Zn, Mo, Ga, In, W, Al, Cu, Ta, Hf, Nb, Sb, V, Fe, Ni, Co, Rh, Pt, or alloys comprising two or more of them, or one or more of oxides of such metals, or composite ceramic oxides, and it is generally 900° C. or higher as a measure. While considering the foregoings, the amount of supply and the supply speed of the inert gas are determined also considering the scale of the apparatus, etc. in actual operation.

For the kind of the inert gas, for example, $N_2$ (nitrogen gas), or a rare gas such as Ar (argon) or He (helium) is typically shown suitably. Further, other gas such as $CO_2$ may also be used depending on the condition.

Then, examples are to be shown below and description is made more specifically. The invention is not restricted by the following examples.

EXAMPLES

Example A

PVA (polyvinyl alcohol) was used as the binder and warm spray coating was effected by using aggregate particles of fine particles of each of titanium oxide and iron oxide.

Examples of coating various kinds of materials using the apparatus shown in FIG. 1 in this case are shown in Table 1 and Table 2.

At the temperature of the jet in Table 2, the heating temperature for the particle of titanium oxide and iron oxide per se is lower than the phase transition temperature for each of them.

FIG. 2 to FIG. 6 are enlarged photographs relevant to Experiment No. 2.

Since similar appearance is shown also in other experimental examples, photographs showing them are omitted.

It has been confirmed that binders are not restricted to PVA but binders known generally so far such as acrylic type, polyester type, polyurethane type or the like can also be used. Further, use of a natural or semi-synthetic binder comprising starch may also be used.

[Table 1]

TABLE 1

| | Fine particles | | Particles | | |
|---|---|---|---|---|---|
| Experiment No. | Material | Main function | Particle diameter nm | Particle diameter nm | Binder |
| 1 | Titanium oxide | Photo catayist | 20 | 25-90 | PVA |
| 2 | " | " | 200 | " | " |
| 3 | " | " | 20 | " | " |
| 4 | " | " | 200 | " | " |
| 5 | " | " | 20 | " | " |
| 6 | " | " | 200 | " | " |
| 7 | " | " | 20 | " | " |
| 8 | " | " | 200 | " | " |
| 9 | " | " | 20 | " | " |
| 10 | " | " | 200 | " | " |
| 11 | " | " | 20 | " | " |
| 12 | " | " | 200 | " | " |
| 13 | " | " | 20 | " | " |
| 14 | " | " | 200 | " | " |
| 15 | " | " | 200 | " | " |
| 16 | " | " | 200 | " | " |
| 17 | Iron oxide | Electron storage | 80 | " | " |
| 18 | " | " | 800 | " | " |
| 19 | " | " | 80 | " | " |
| 20 | " | " | 800 | " | " |
| 21 | " | " | 80 | " | " |
| 22 | " | " | 800 | " | " |
| 23 | " | " | 80 | " | " |
| 24 | " | " | 800 | " | " |
| 25 | " | " | 80 | " | " |
| 26 | " | " | 800 | " | " |
| 27 | " | " | 80 | " | " |
| 28 | " | " | 800 | " | " |
| 29 | " | " | 80 | " | " |
| 30 | " | " | 800 | " | " |
| 31 | " | " | 800 | " | " |
| 32 | " | " | 800 | " | " |

TABLE 2

| Experiment No. | Blowing (spray jet) Temperature K | Velocity m/s | Distance* mm | Object to be treated Material | Thickness mm | Result Film thickness μm | Provision of main function |
|---|---|---|---|---|---|---|---|
| 1 | 1590.8 | 1337.5 | 50 | (A) | 6 | (*2) | (*1) |
| 2 | 1469.9 | 1030.5 | 100 | " | " | " | " |
| 3 | 1378.5 | 1314.0 | 50 | " | " | " | " |
| 4 | 1340.3 | 1109.5 | 100 | " | " | " | " |
| 5 | 1191.2 | 1262.0 | 50 | " | " | " | " |
| 6 | 1190.1 | 1128.4 | 100 | " | " | " | " |
| 7 | 1590.8 | 1337.5 | 50 | " | " | 5 | ○ |
| 8 | " | " | " | " | " | " | " |
| 9 | 1469.9 | 1030.5 | 100 | " | " | " | " |
| 10 | " | " | " | " | " | " | " |
| 11 | 1378.5 | 1314.0 | 50 | " | " | " | " |
| 12 | " | " | " | " | " | " | " |
| 13 | 1340.3 | 1103.5 | 100 | " | " | " | " |
| 14 | " | " | " | " | " | " | " |
| 15 | 1468.9 | 1030.5 | " | (B) | " | " | " |
| 16 | 1340.3 | 1103.5 | " | " | " | " | " |
| 17 | 1052.7 | 596.1 | 150 | (A) | " | (*2) | (*1) |
| 18 | 840.1 | 412.9 | 200 | " | " | " | " |
| 19 | 1008.6 | 665.0 | 150 | " | " | " | " |
| 20 | 810.0 | 465.3 | 200 | " | " | " | " |
| 21 | 956.1 | 718.2 | 150 | " | " | " | " |
| 22 | 778.0 | 510.6 | 200 | " | " | " | " |
| 23 | 1590.8 | 1337.5 | 50 | " | " | 5 | ○ |
| 24 | " | " | " | " | " | " | " |
| 25 | 1469.9 | 1030.5 | 100 | " | " | " | " |
| 26 | " | " | " | " | " | " | " |
| 27 | 1378.5 | 1314.0 | 50 | " | " | " | " |
| 28 | " | " | " | " | " | " | " |
| 29 | 1340.3 | 1103.5 | 100 | " | " | " | " |
| 30 | " | " | " | " | " | " | " |
| 31 | 1469.9 | 1030.5 | " | (B) | " | " | " |
| 32 | 1340.3 | 1103.5 | " | " | " | " | " |

Distance*: distance from the top end of the barrel ($$) to the surface of an object to be treated (B)
(*1): since this is for confirming coating condition, main function is not confirmed.
○: function inherent to fine particles were provided satisfactory.
(*2): coiliding and deposition of powdery particles were confirmed but film thickness was not measured.
(A): 315 stainless steel
(B): SS400 carbon steel Experiments Nos. 1 to 6 and Experiments Nos. 17 to 22 confirm whether the particles can be deposited reliably or not but do not evaluate function.

Fine particles are obtained by mixing 2 mass % of the binder in the table and pelleting the same by a spray dry method to obtain particles in the table.

For confirmation of function, the photo catalyst function in a case of titanium oxide and the electron storage function in a case of iron oxide are evaluated by the following method.

Photo catalyst function: A coating immersed in an electrolyte and UV-rays are irradiated to the surface thereof. In this state, the electrode potential of the coating is scanned in a positive direction and the value of the flowing current (photo current) is measured. Comparison is made by the level thereof.

Electron storage function: A coating is immersed in an electrolyte, the electrode potential of the coating is scanned in the negative direction, and peak area of the flowing current (charging capacity), and the electrode potential is scanned in the positive direction and the peak area of the flowing current (discharging capacity) is measured. Comparison is made based on the level thereof.

In the confirmation by such evaluation method, influence due to the binder was not found. Since the temperature during spray exceeds the evaporization or sublimation temperature of the binder, it is considered that the most of the binder is evaporized or sublimated by the heating during spraying.

Example B

Warm spray coating was effected using a particle mixture in which both of the standard particle and the additive particle were formed of titanium.

That is, each of the particles of Experimental Examples 1 to 12 was sprayed as shown in Table 3 by using the apparatus shown in FIG. 1 under the following conditions, thereby confirming the performance thereof.

Fuel (kerosene): 0.30 $dm^3$/min
Oxygen: 0.63 $m^3$/min
Nitrogen: 1.50 $m^3$/min
Distance from gun exit to substrate: 100 mm
Number of pass: 8
Gun moving speed: 700 mm/s
pitch width: 4 mm
N2 (name): 1500 L/min
Particle material: titanium
Material for member as an object: carbon steel Also the result of evaluation for the denseness of the formed film is shown in Table 3.

In Table 3, Ep, and Rc mean the followings.

Corrosion potential Ep: Steady value for immersion potential of a specimen electrode (titanium coating • carbon steel substrate) to silver • silver chloride reference electrode in artificial sea water.

Corrosion resistance Rc: two sheets of specimen electrodes (titanium coating • carbon steel substrate) are opposed to each other and an AC voltage is applied to between both electrodes. The resistance value Rc in corrosion reaction is determined by subtracting the impedance at high frequency (10 kHz) from the impedance at low frequency (100 mHz).

In this case, high Rc value shows that a dense coating is formed. The porosity P has a relation with the value Rc by an electrochemical method. Further, measurement for Rc is more convenient compared with that for the porosity. Rc can be used as a measure for the porosity (denseness).

Further, Pmin (vol %) shows a minimum porosity.

Low porosity P means that the denseness is high. Further, when the porosity reduces to 0%, this means complete denseness. In a general flame sprayed film, the denseness can be considered high when the porosity is 1% or less. In the measuring method, mercury is packed in the pores and the amount thereof is measured as described above. In view of the interpretation on the data, the numerical value cannot but be expressed as this is within a certain range. Then, in Table 3, the minimum porosity Pmin (that is, maximum denseness) is indicated.

Then, in Table 3, Pmin is shown for the highest porosity (Experiment No. 1: comparative example) and for the lowest porosity and the highest denseness (Experiment No. 4: example).

A salt water immersion test was carried out. In the test, a sample was immersed in artificial sea water for 3 days, during which the corrosion potential Ep and the corrosion resistance Rc were measured and denseness of the coating was judged based on the value reaching a steady state after lapse of 24 hours.

of prepared coatings, in which a lateral line present below is a boundary between carbon steel used as a substrate and a titanium layer as a coating. Further, in the cross section, a black area is a portion where titanium particles are not yet filled and the black portion decreases as the coating becomes more dense. Further, "photographs showing the result of salt water immersion test" show those obtained by applying titanium coating on carbon steel, then leaving a central portion in a circular shape on the surface of the coating and insulatively coating other portions by a silicon resin. This is for measuring whether red rust (appearing black in photograph) derived from carbon steel develops or not at the coating surface thereby confirming whether penetrative pores are present or not in the coating by immersing the same in salt water.

Example C

Among aggregate particles of 25 to 90 μm of Experiment No. 1 in Table 1, those corresponding to the particle diameter shown for Experiment No. 4 in Table 3 were selected, and a particle mixture of aggregate particles was prepared in the same manner as that shown in Experiment No. 4.

The particles can be selected to a particle diameter in an appropriate range by a vibration sieve device, and the selected particles can be mixed at an optional ratio and supplied to a spray apparatus with no troubles.

They were blown under the same conditions as those in Experiment No. 9 in Table 3.

As a result, not only the same effects as those in Experiment No. 9 could be obtained but also a layer of dense fine

TABLE 3

| Experiment | Standard particle Particle diameter | | Mass | Additive particle Particle diameter | | | | | Result | | |
|---|---|---|---|---|---|---|---|---|---|---|---|
| | | | | | | | | | Ep | Rc | Pmin |
| No. | 1) | B | % | 1) | C | D | A | K Value | (mV) | (Ω) | (vol %) |
| 1 (Comparative Example) | 25-45 | 35 | 100 | — | — | — | — | — | 503 | 2220 | 2.3 |
| 2 (Comparative Example) | 25-45 | 35 | 90 | 60-90 | 75 | 3 | 10 | 14 | 432 | 2180 | |
| 3 (Comparative Example) | 25-45 | 35 | 95 | 60-90 | " | " | 5 | 7 | 465 | 2340 | |
| 4 (Comparative Example) | 25-45 | 35 | 99 | 60-90 | " | " | 1 | 1.4 | 328 | 13300 | 0.8 |
| 5 (Comparative Example) | 90-150 | 120 | 100 | — | — | — | — | — | 597 | 575 | |
| 6 (Comparative Example) | 25-45 | 35 | 50 | 90-150 | 120 | 6 | 50 | 87.5 | 597 | 575 | |
| 7 (Comparative Example) | 25-45 | 35 | 90 | 90-150 | " | " | 10 | 17.5 | 572 | 728 | |
| 8 (Comparative Example) | 25-45 | 35 | 95 | 90-150 | " | " | 5 | 8.75 | 584 | 536 | |
| 9 (Example) | 25-45 | 35 | 99 | 90-150 | " | " | 1 | 1.75 | 480 | 3330 | |
| 10 (Comparative Example) | 25-45 | 35 | 90 | 45-150 | 97.5 | 105 | 10 | 377 | 552 | 697 | |
| 11 (Comparative Example) | 25-45 | 35 | 95 | 45-150 | " | " | 5 | 188 | 614 | 1780 | |
| 12 (Comparative Example) | 25-45 | 35 | 99 | 45-150 | " | " | 1 | 37.7 | 629 | 1620 | |

1) Range for particle diameter (μm)
A: Mass % for the content of additive particle
B: Central particle diameter of standard particle (μm)
C: Central particle diameter of additive particle (μm)
D: (Maximum particle diameter − minimum diameter) of additive particle/10 Power was supplied by a screw feeder.

Experiment No. 4 and Experiment No. 9 in Table 3 are examples of the invention in which the K value is within a range from 1 to 2, and it can be seen that remarkable denseness is obtained.

Appended FIG. 7 to FIG. 42 show;

cross sectional photographs of coating layers (FIGS. 7, 10, 13, 16, 19, 22, 25, 28, 31, 34, 37, 40), enlarged cross sectional views by 4× of the coating layers (FIGS. 8, 11, 14, 17, 20, 23, 26, 29, 32, 35, 38,41), and photographs showing the result of the salt water immersion test of samples (FIGS. 9, 12, 15, 18, 21, 24, 27, 30, 33, 34, 39, 42) for each of specimens in Experiments Nos. 1 to 12.

"Cross sectional photographs and enlarged photographs thereof for coating layers" express the traverse cross section particles superior to that of Experiment No. 9 could be obtained, and adhesion strength was strong.

INDUSTRIAL APPLICABILITY

The coating method of the invention using the aggregate particle comprising fine particles can be used effectively for the coating of a functional material to an object to be treated, for example, in corrosion inhibition of structural steels (bridge peers, inner walls for nuclear reactor core containment vessels, etc.), solar energy conversion-storage devices (solar panels, etc.), purification of atmospheric air contaminants (in express highway guide rails, etc.).

Further, according to the invention of using a mixture of the standard particle and the additive particle, since a dense film is formed, this is optimal to the coating intended for prevention of corrosion of less corrosion resistant materials. Specifically, this is effective for corrosion proof coating for less corrosion resistant materials, for example, structural steels such as bridge peers or building materials, chemical plants such as reaction vessels, various kinds of rolls used, for example, for paper making, metal materials used for biobody in-plants, and sea water heat exchangers.

The invention claimed is:

1. A warm spray coating method, comprising:

providing a plurality of aggregates, wherein each aggregate comprises a binder comprising an organic compound, and particles having an identical composition and having a particle diameter smaller than a diameter of the aggregate, and each aggregate does not comprise other particles;

heating and blowing the aggregates in a warm spray having a temperature of $4\times10^{2\circ}$ C. to $25\times10^{2\circ}$ C. at a supersonic velocity on an object to be treated, wherein the aggregates are heated to a temperature equal to or higher than a sublimation or vaporization temperature of the binder and equal to or lower than a phase transition temperature of the particle; and depositing the particles on the object.

2. The warm spray coating method according to claim 1, wherein the particles comprise an oxide crystal.

3. A warm spray coating method, comprising:

providing a mixture of standard aggregates and additive aggregates, wherein each standard aggregate and additive aggregate comprises a binder comprising an organic compound, and particles having an identical composition; and having a particle diameter smaller than a diameter of the standard aggregate and additive aggregate, each standard aggregate has a diameter of 45 μm or less, and each additive aggregate has a diameter larger than the standard aggregate, each standard aggregate and additive aggregate does not comprise other particles, and the mixture has a K value, determined by the following formula, of greater than or equal to 1 and less than or equal to 2:

$$K=A\times(B/C)\times D$$

A: mass % of the content of additive aggregate

B: center diameter of standard aggregate (μm)

C: center diameter of additive aggregate (μm)

D: (maximum diameter−minimum diameter) of additive aggregate/10 (μm);

heating and blowing the mixture in a warm spray having a temperature of $4\times10^{2\circ}$ C. to $25\times10^{2\circ}$ C. at a supersonic velocity on an object to be treated, wherein the mixture is heated to a temperature equal to or higher than a sublimation or vaporization temperature of the binder and equal to or lower than a phase transition temperature of the particle; and depositing the particles on the object.

4. A mixture of standard aggregates and additive particle aggregates, wherein each standard aggregate and additive aggregate comprises particles having an identical composition, and having a particle diameter smaller than a diameter of the standard aggregate and additive aggregate, each standard aggregate has a diameter of 45 μm or less, and each additive aggregate has a diameter larger than the standard aggregate, each standard aggregate and additive aggregate does not comprise other particles, and the mixture has a K value, determined by the following formula, of greater than or equal to 1 and less than or equal to 2:

$$K=A\times(B/C)\times D$$

A: mass % of the content of additive aggregate

B: center diameter of standard aggregate (μm)

C: center diameter of additive aggregate (μm)

D: (maximum diameter−minimum diameter) of additive aggregate/10 (μm).

5. The mixture according to claim 4, wherein at least one of the standard aggregate and the additive aggregate comprises particles having a diameter of 10 nm to 1000 nm.

* * * * *